US011603837B2

(12) United States Patent
Pittendrigh

(10) Patent No.: US 11,603,837 B2
(45) Date of Patent: Mar. 14, 2023

(54) ROTARY FLUID DEVICE

(71) Applicant: Cameron James Pittendrigh, Sydney (AU)

(72) Inventor: Cameron James Pittendrigh, Sydney (AU)

( * ) Notice: Subject to any disclaimer, the term of this patent is extended or adjusted under 35 U.S.C. 154(b) by 18 days.

(21) Appl. No.: 16/978,426

(22) PCT Filed: Mar. 7, 2019

(86) PCT No.: PCT/AU2019/050196
§ 371 (c)(1),
(2) Date: Sep. 4, 2020

(87) PCT Pub. No.: WO2019/169443
PCT Pub. Date: Sep. 12, 2019

(65) Prior Publication Data

US 2021/0040948 A1 Feb. 11, 2021

(30) Foreign Application Priority Data

Mar. 8, 2018 (AU) ..... 2018900750

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/344*** | (2006.01) |
| ***F01C 21/08*** | (2006.01) |

(52) U.S. Cl.
CPC ..... *F04C 2/3446* (2013.01); *F01C 21/0809* (2013.01); *F01C 21/0845* (2013.01)

(58) Field of Classification Search
CPC ..... F04C 2/344; F04C 2/3446; F04C 2/356; F01C 21/0818; F01C 21/0827; F01C 21/0845; F01C 21/0809; F03C 2/30
See application file for complete search history.

(56) References Cited

U.S. PATENT DOCUMENTS 1,269,937 A 6/1918 Hutsell
1,364,438 A * 1/1921 Johnson ..... F04C 2/322 418/177

(Continued)

OTHER PUBLICATIONS

International Search Report and Written Opinion of PCT/AU2019/050196 dated Jun. 18, 2019, 17 pages.

*Primary Examiner* — Theresa Trieu
(74) *Attorney, Agent, or Firm* — Rankin, Hill & Clark LLP

(57) ABSTRACT

A rotary fluid device including an outer housing assembly and an inner rotating arrangement adapted to rotate relative to the outer housing assembly, the outer housing assembly including a rotor housing and the inner rotating arrangement including a rotor dimensioned to rotatably fit within the rotor housing. One of the rotor and the rotor housing include lobes extending in a radial direction relative to respective inner and outer circumferential surfaces and the other of the rotor and the rotor housing includes followers and follower recesses in which the followers are moveably located. Three pressure zones may be defined between the followers and follower recesses the three pressure zones including an intermediate pressure zone and two laterally pressure zones on opposing circumferentially lateral sides of the intermediate pressure zone.

23 Claims, 27 Drawing Sheets

(56) References Cited

U.S. PATENT DOCUMENTS

| | | | | | |
|---|---|---|---|---|---|
| 2,856,861 | A * | 10/1958 | Adams | F01C 21/0809 | 418/267 |
| 3,016,184 | A * | 1/1962 | Hart | F04C 18/344 | 418/76 |
| 3,062,193 | A * | 11/1962 | Zwicky | F01C 21/0845 | 418/248 |
| 3,244,157 | A * | 4/1966 | Tanferna | F01C 21/0836 | 418/246 |
| 5,064,362 | A | 11/1991 | Hansen | | |
| 7,614,861 | B2 * | 11/2009 | Nagler | F01C 1/3441 | 418/146 |
| 2011/0171054 | A1 * | 7/2011 | Patterson | F04C 27/001 | 418/144 |
| 2014/0140880 | A1 * | 5/2014 | Wheeler | F01C 21/0809 | 418/143 |
| 2015/0192122 | A1 * | 7/2015 | Wheeler | F01C 21/0827 | 418/243 |

* cited by examiner

ROTARY FLUID DEVICE

RELATED APPLICATIONS

This application claims priority from Australian provisional patent application no. 2018900750 filed on 8 Mar. 2018, the contents of which are incorporated by reference.

TECHNICAL FIELD

The invention relates to a rotary fluid device, and in particular, a rotary fluid device in the form of a rotary hydraulic motor or pump.

BACKGROUND

Hydraulic motors are used to convert hydraulic pressure and flow into torque and rotation. Such hydraulic motors generally include an outer housing having an inlet port and an outlet port, and an internal rotatable arrangement within the housing that is rotated when hydraulic fluid passes between the inlet and outlet ports to rotate a drive shaft.

The internal rotatable arrangement may include an inner rotatable body having vanes or other surfaces on which the hydraulic fluid acts to rotate the inner rotatable body and the drive shaft. Chambers between the vanes are arranged to selectively align with the inlet and outlet ports of the outer housing in a manner to maintain rotation of the inner rotatable body.

Problems with hydraulic motors relate to the efficiency of the motor, variation or "wobble" in the output torque, size of the motor, complexity of construction and cost of manufacturing.

The invention disclosed herein seeks to overcome one or more of the above identified problems or at least provide a useful alternative.

SUMMARY

In accordance with a first broad aspect there is provided, a rotary fluid device, the rotary fluid device including an outer housing assembly and an inner rotating arrangement adapted to rotate relative to the outer housing assembly, the outer housing assembly including a rotor housing and the inner rotating arrangement including a rotor dimensioned to rotatably fit within the rotor housing.

The rotor includes opposing sides and an outer circumferential surface and the rotor housing includes an inner circumferential surface extending about the outer circumferential surface of the rotor.

One of the rotor and the rotor housing include lobes extending in a radial direction relative to the respective inner and outer circumferential surfaces and the other of the rotor and the rotor housing includes followers and follower recesses in which the followers are moveably located.

The lobes are arranged to define troughs therebetween extending between the inner and outer circumferential surfaces and the followers are moveable between an extended condition and a retracted condition relative to the follower recesses so as to substantially sealably follow the respective one of the inner and outer circumferential surfaces with the troughs being dividable by the followers during rotation of the rotor into chambers.

At least one of the rotor and the rotor housing includes a port arrangement such that circumferentially adjacent ones of the chambers are provided with a differential in fluid pressure so as to urge the rotor in a circumferential direction.

The followers and follower recesses are adapted such that in at least the extended condition fluid pressure at underside facing surfaces of the followers toward the follower recesses are substantially hydrostatically balanced with a fluid pressure at opposing top facing surfaces of the followers substantially exposed to the chambers.

In an aspect, the followers each include a head portion adapted to slidably engage with the respective one of the inner and outer circumferential surfaces and a base portion received by the follower recess.

In another aspect, the followers and follower recesses are shaped to define, at least in the extended condition, an intermediate pressure zone at least partially between the head portion and the follower recess, and adjacent pressure zones on each circumferentially adjacent side of the intermediate pressure zone.

In yet another aspect, the top facing surfaces include a tip surface of the head portion of the followers and wherein the head portion is adapted to allow the passage of fluid between the tip surface thereof to the intermediate pressure zone.

In yet another aspect, the head portion includes at least one aperture extending from the tip surface to the intermediate pressure zone.

In yet another aspect, the intermediate pressure zone is within the recess.

In yet another aspect, the underside facing surfaces of the followers include an underside surface of the head portion, and wherein the at least one aperture extends from the tip surface to the underside surface of the head portion.

In yet another aspect, the underside facing surfaces of the followers include underside surfaces of the base portion.

In yet another aspect, the top facing surfaces of the followers include top facing surfaces of the base portion.

In yet another aspect, the adjacent pressure zones are located at least partially between the underside surfaces of the base portion and the follower recess in at least the elevated condition.

In yet another aspect, the adjacent pressure zones and the intermediate pressure zone are separated from one another by a divider provided by at least one of the followers and follower recesses.

In yet another aspect, the three pressure zones are substantially independent.

In yet another aspect, the base portion includes locating portions located on opposing sides thereof, the locating portions being adapted to be slidably received by the recesses.

In yet another aspect, the adjacent pressure zones are provided between an underside of the locating portions and the follower recesses in at least the elevated condition.

In yet another aspect, the followers and follower recesses are shaped to provide passages to communicate fluid with the adjacent pressure zones.

In yet another aspect, the passages are provided between the locating portions.

In yet another aspect, the lobes are equally spaced about the respective one of the rotor and the rotor housing.

In yet another aspect, the at least two followers are provided for each of the lobes.

In yet another aspect, the rotor carries the followers and the rotor housing includes the lobes.

In yet another aspect, the rotor housing has three lobes equally spaced apart there-about and the rotor has nine follower recesses with nine corresponding evenly spaced apart followers.

In yet another aspect, the followers are biased away from the respective follower recesses.

In yet another aspect, a spring is provided between the follower recesses and the followers.

In yet another aspect, in at least the extended condition an intermediate pressure zone and two lateral pressure zones are defined between underside surfaces of the followers and the follower recesses, the intermediate pressure zone and two lateral pressure zones of each follower being divided by the arrangement of the followers and the follower recesses and each of the intermediate pressure zone and two lateral pressure zones having one of a passage and aperture so as to be in fluid communication with the respective chambers.

In yet another aspect, in at least the extended condition an intermediate pressure zone is defined between the head portion of the followers and the follower recess, and wherein the follower includes an aperture between the intermediate pressure zone and surface of the head portion exposed to the chamber so as to allow hydrostatic balancing thereof.

In yet another aspect, tips of the lobes include moveable inserts intermediate thereof.

In yet another aspect, the inserts and the followers include wear surfaces formed of a material relatively softer than the rotor.

In yet another aspect, the insert is wider in a circumferential direction than the head portion of the followers.

In yet another aspect, the inserts are located by an insert chamber, the inserts being bias away from the insert chamber.

In yet another aspect, the inserts include an aperture between an underside surface thereof to an opposing tip surfaces exposed to the chamber so as to allow hydrostatic balancing thereof.

In yet another aspect, the rotor housing includes an inlet port and an outlet port on each circumferential side of the lobes.

In yet another aspect, the fluid direction between the inlet port and an outlet port is reversible such that the rotor is operable in a forward and a reverse direction.

In yet another aspect, the lobes are shaped such that the troughs defined therebetween taper at opposing ends thereof toward tips of the lobes.

In yet another aspect, the troughs between the lobes are shaped such that the greatest cross-sectional area of the chambers is at a centre of the troughs between the lobes.

In yet another aspect, the rotary fluid device is a hydraulic motor or pump.

In yet another aspect, the rotor housing is fixed relative to the rotor.

In accordance with a second broad aspect there is provided, a rotary fluid device, the rotary fluid device including an outer housing assembly and an inner rotating arrangement adapted to rotate relative to the outer housing assembly, the outer housing assembly including a rotor housing and the inner rotating arrangement including a rotor dimensioned to rotatably fit within the rotor housing, wherein the rotor includes opposing sides and an outer circumferential surface and the rotor housing includes an inner circumferential surface extending about the outer circumferential surface of the rotor, wherein one of the rotor and the rotor housing include lobes extending in a radial direction relative to the respective inner and outer circumferential surfaces and the other of the rotor and the rotor housing includes followers and follower recesses in which the followers are moveably located.

The lobes are arranged to define troughs therebetween extending between the inner and outer circumferential surfaces and the followers are moveable between an extended condition and a retracted condition relative to the follower recesses so as to substantially sealably follow the respective one of the inner and outer circumferential surfaces with the troughs being dividable by the followers during rotation of the rotor into chambers, and at least one of the rotor and the rotor housing includes a port arrangement such that circumferentially adjacent ones of the chambers are provided with a differential in fluid pressure so as to urge the rotor in a circumferential direction, and wherein the followers and follower recesses are adapted such that in at least the extended condition fluid pressure at least a some of underside facing surfaces of the followers are substantially hydrostatically balanced with a fluid pressure at least some of opposing top facing surfaces of the followers substantially exposed to the chambers.

In accordance with a third broad aspect there is provided, a rotary fluid device, the rotary fluid device including an outer housing assembly and an inner rotating arrangement adapted to rotate relative to the outer housing assembly, the outer housing assembly including a rotor housing and the inner rotating arrangement including a rotor dimensioned to rotatably fit within the rotor housing.

The rotor includes opposing sides and an outer circumferential surface and the rotor housing includes an inner circumferential surface extending about the outer circumferential surface of the rotor, wherein one of the rotor and the rotor housing include lobes extending in a radial direction relative to the respective inner and outer circumferential surfaces and the other of the rotor and the rotor housing includes followers and follower recesses in which the followers are moveably located, wherein the lobes are arranged to define troughs therebetween extending between the inner and outer circumferential surfaces and the followers are moveable between an extended condition and a retracted condition relative to the follower recesses so as to substantially sealably follow the respective one of the inner and outer circumferential surfaces with the troughs being dividable by the followers during rotation of the rotor into chambers.

At least one of the rotor and the rotor housing includes a port arrangement such that circumferentially adjacent ones of the chambers are provided with a differential in fluid pressure so as to urge the rotor in a circumferential direction, and wherein the followers and follower recesses are adapted such that in at least the extended condition at least one pressure zone is defined between the followers and the recesses, the at least one pressure zone being in communication with a fluid source.

In an aspect, the fluid source is one of a fluid within the chamber proximate a head surface of the follower and a positively pressurised fluid provided via a pilot conduit to the pressure zone.

In another aspect, a plurality of pressure zones are formed between the followers and follower recesses, each of the plurality of pressure zones being in communication with fluid at different pressures so as to allow communication of pressure to each of the plurality of pressure zones.

In accordance with a fourth broad aspect there is provided, a rotary fluid device, the rotary fluid device including an outer housing assembly and an inner rotating arrangement adapted to rotate relative to the outer housing assembly, the outer housing assembly including a rotor housing and the inner rotating arrangement including a rotor dimensioned to rotatably fit within the rotor housing, wherein the rotor includes opposing sides and an outer circumferential surface and the rotor housing includes an inner circumferential surface extending about the outer circumferential surface of the rotor.

One of the rotor and the rotor housing include lobes extending in a radial direction relative to the respective inner and outer circumferential surfaces and the other of the rotor and the rotor housing includes followers and follower recesses in which the followers are moveably located, wherein the lobes are arranged to define troughs therebetween extending between the inner and outer circumferential surfaces and the followers are moveable between an extended condition and a retracted condition relative to the follower recesses so as to substantially sealably follow the respective one of the inner and outer circumferential surfaces with the troughs being dividable by the followers during rotation of the rotor into chambers, and at least one of the rotor and the rotor housing includes a port arrangement such that circumferentially adjacent ones of the chambers are provided with a differential in fluid pressure so as to urge the rotor in a circumferential direction.

The followers and follower recesses are adapted such that in at least the extended condition three pressure zones are defined or provided between the followers and follower recesses, the three pressure zones including an intermediate pressure zone and two laterally pressure zones on opposing circumferentially lateral sides of the intermediate pressure zone.

BRIEF DESCRIPTION OF THE FIGURES

The invention is described, by way of non-limiting example only, by reference to the accompanying figures, in which.

DETAILED DESCRIPTION

First Example

Figure 1A:
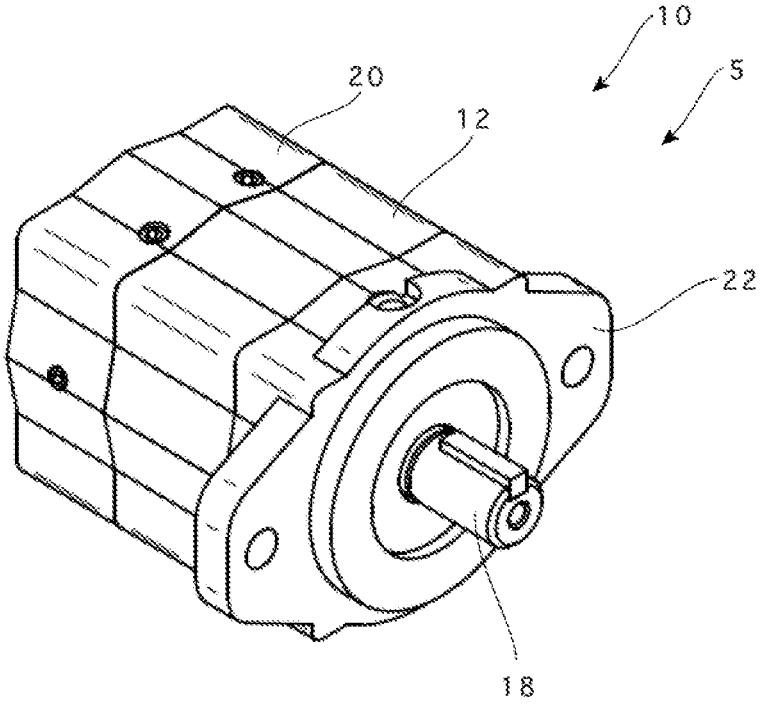
FIGS. 1*a* and 1*b* are isometric topside view and a rear top view illustrating an example of a rotary fluid device in the form of a rotary hydraulic motor.
Figure 1B:
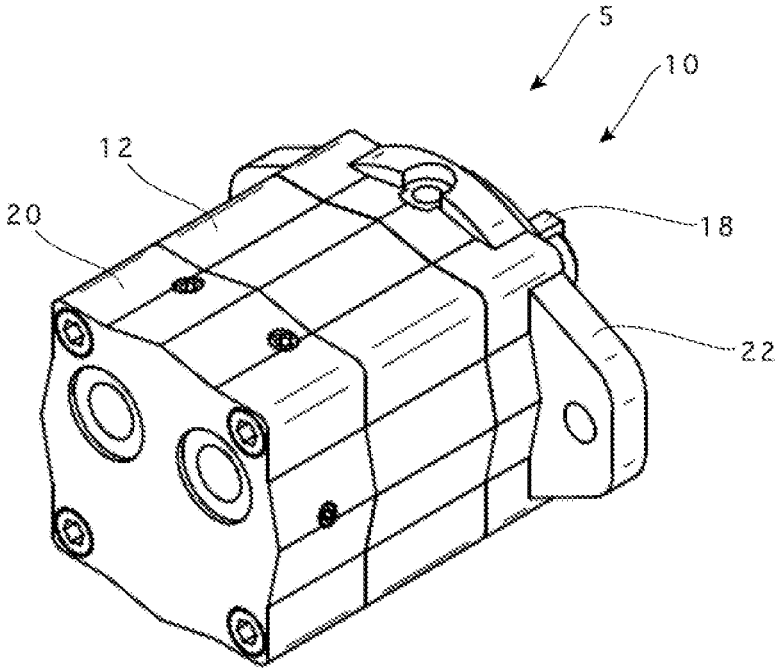
Figure 2A:
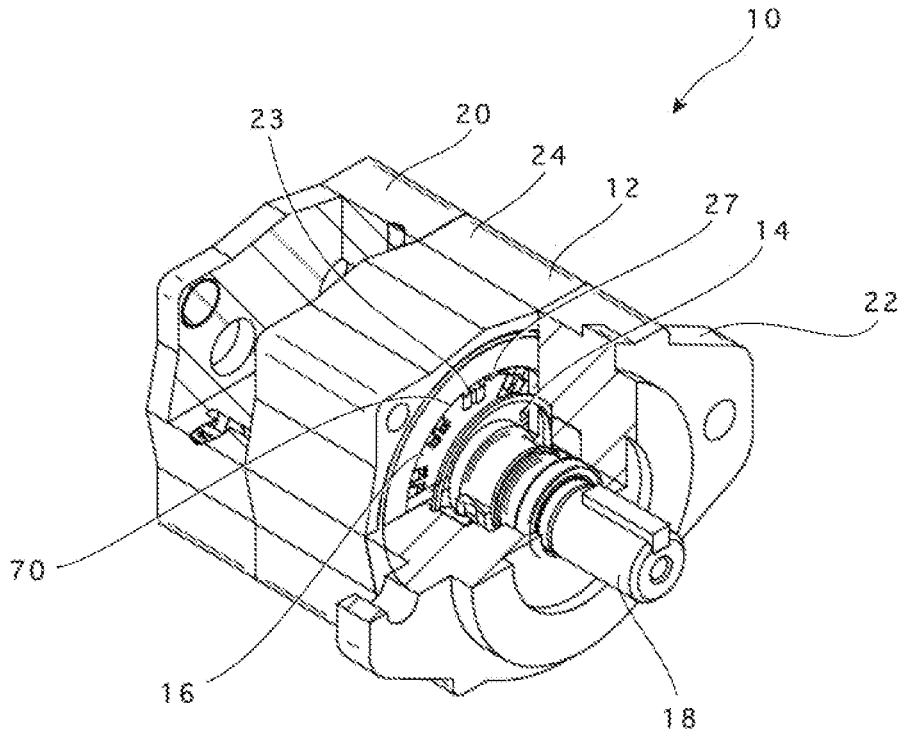
FIGS. 2*a* and 2*b* are isometric cut-away views illustrating the internal arrangement of the motor with progressive removal of parts to aid clarity.
Figure 2B:
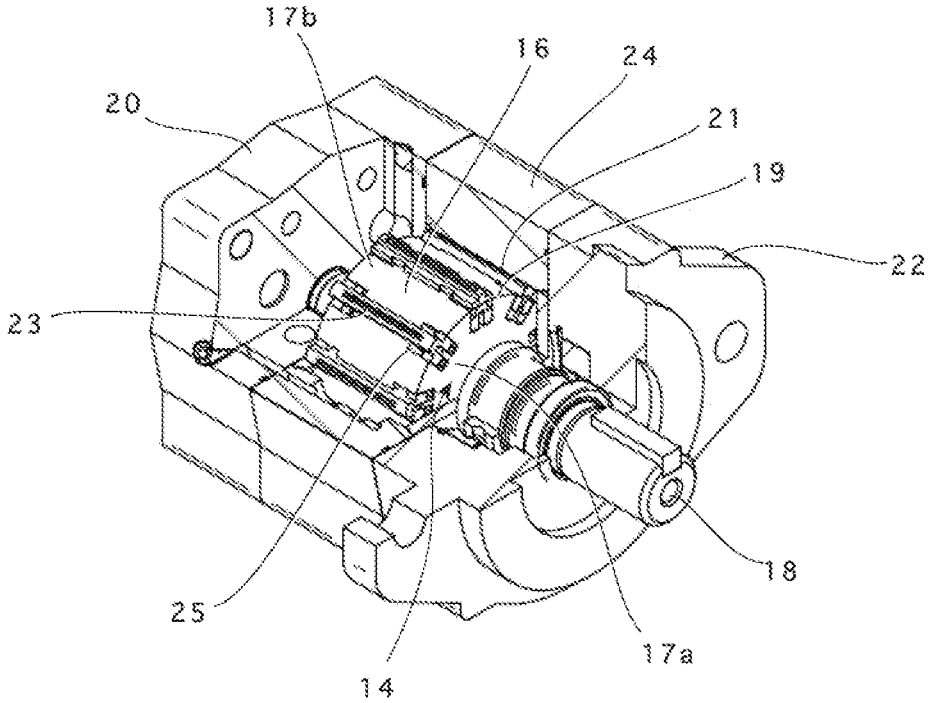

Referring initially to FIGS. 1*a* to 3, there is shown a first example of a rotary fluid device 5 in the form of a rotary hydraulic motor 10. The hydraulic motor 10 includes an outer housing assembly 12 and an inner rotating arrangement 14 adapted to rotate relative to the outer housing assembly 12. The inner rotating arrangement 14 includes a rotor 16 and a shaft 18. The outer housing assembly 12 includes a rear housing 20, a front housing 22 and an intermediate rotor housing 24 between the rear housing 20 and the front housing 22 in which the rotor 16 is housed.

The rotor 16 includes opposing sides 17*a*, 17*b* and an outer circumferential surface 19 and the rotor housing 24 includes an inner circumferential surface 21 extending about the outer circumferential surface of the rotor 19. In this example, the rotor housing 24 includes lobes 15 extending in an inward radial direction relative to the inner circumferential surface 21 and the rotor 16 includes followers 23 and follower recesses 25 in which the followers 23 are moveably located.

In this first example, it is noted that the rotor housing 24 includes the lobes 15 and the rotor 16 carries the followers 23 within the follower recesses 25. However, in the second example below the arrangement may be reversed. Accordingly, both examples are contemplated herein The lobes 15 are arranged to define troughs 66 (shown best in FIG. 11*a*) therebetween to receive a working fluid. The troughs 66 extending between the inner and outer circumferential surfaces 21, 19 and the followers 23 are moved between an extended condition and a retracted condition toward the follower recesses 25 so as to substantially sealably follow the respective one of the inner and outer circumferential surfaces 21, 19. The troughs 66 are dividable by the followers 23 during rotation of the rotor 16 into chambers 70 between the lobes 15. The followers 23, troughs 66 and chambers 70 are best shown FIGS. 11*a* and 11*b*.

Preferably, the rotary fluid device 5 functions as a hydraulic motor in which the working fluid is oil. However, the rotary fluid device 5 may also function as a pump and make use of other working fluids. When operating as a pump, the rotary fluid device 5 may be driven by rotation of the shaft 18.

Rear Housing

Figure 3:
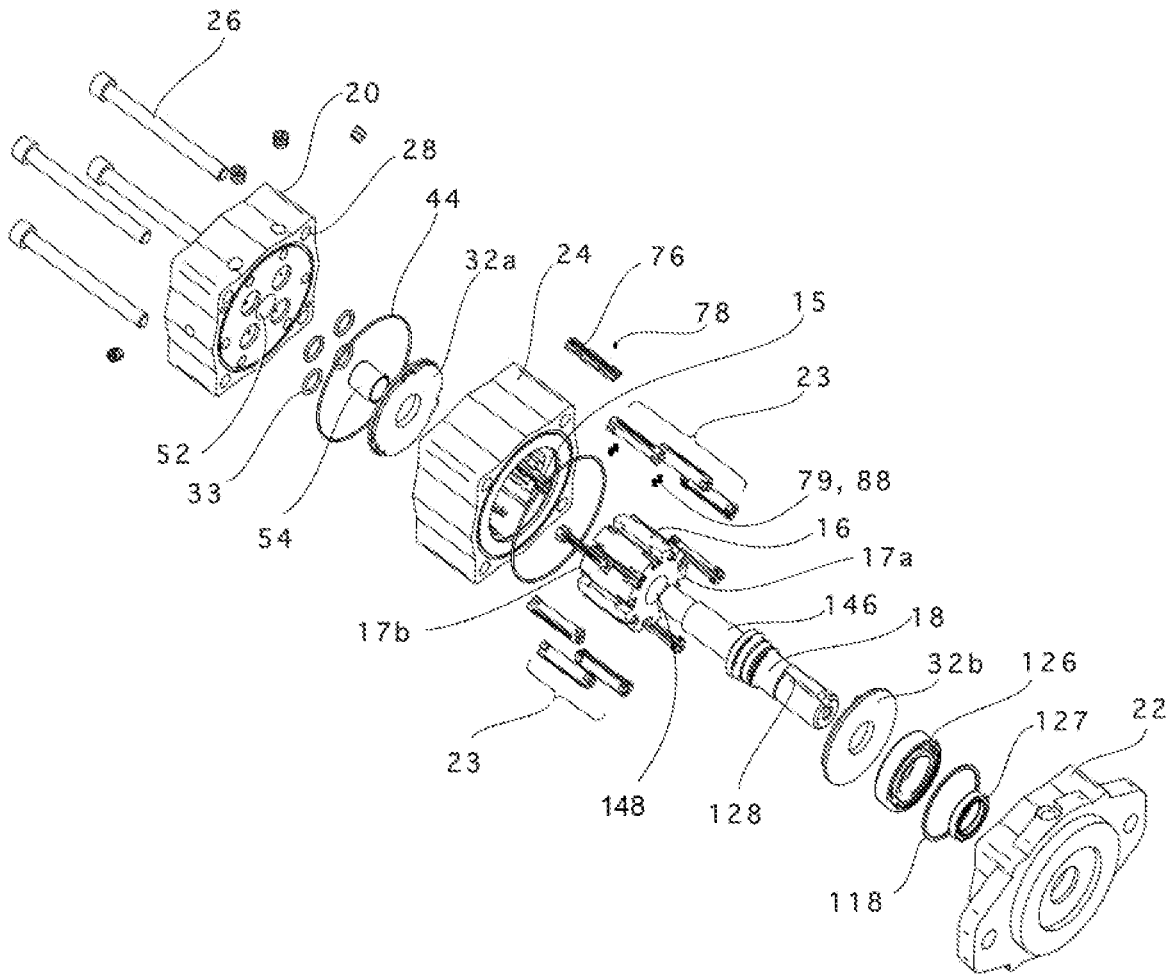
FIG. 3 is an exploded parts view illustrating the motor.
Figure 4A:
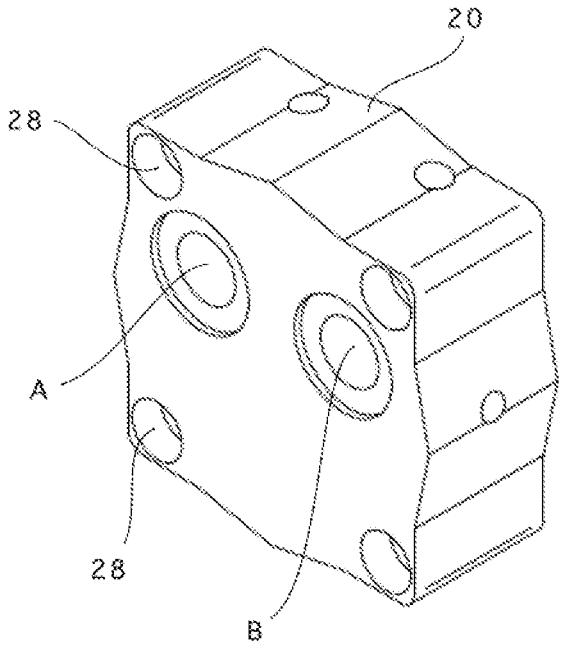
FIGS. 4*a*, 4*b* and 4*c* are respective isometric rear, isometric front and side sectional views illustrating a rear housing of the motor.
Figure 4B:
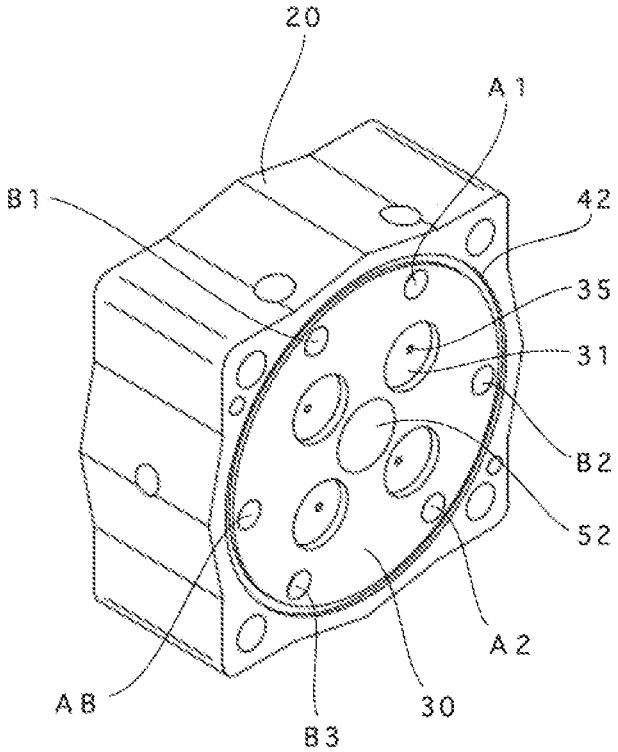
Figure 4C:
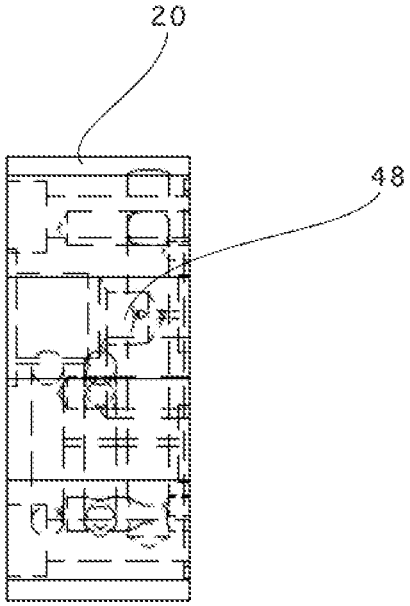
Figure 5A:
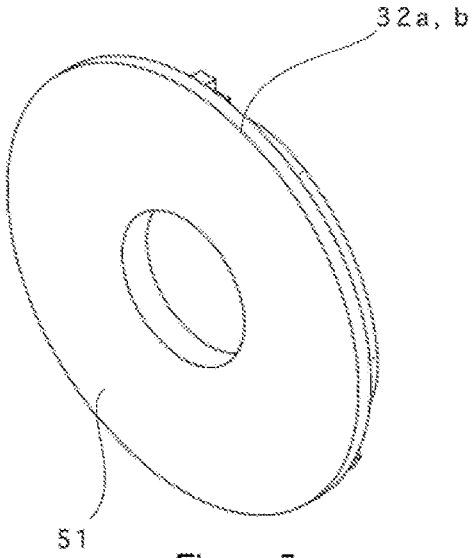
FIGS. 5*a* to 5*d* are respective illustrate isometric front, back, side and front hidden detail views illustrating a thrust plate of the motor.
Figure 5B:
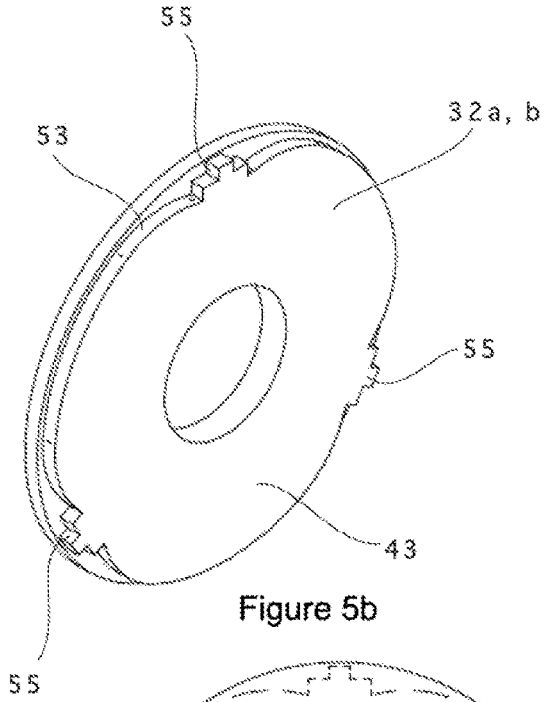
Figure 5C:
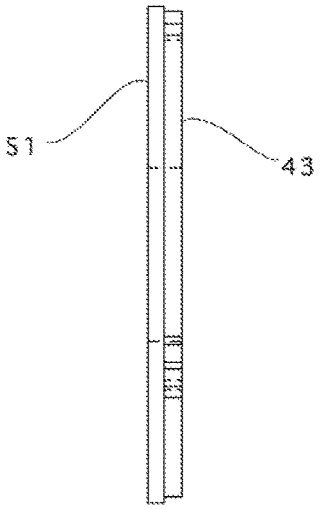
Figure 5D:
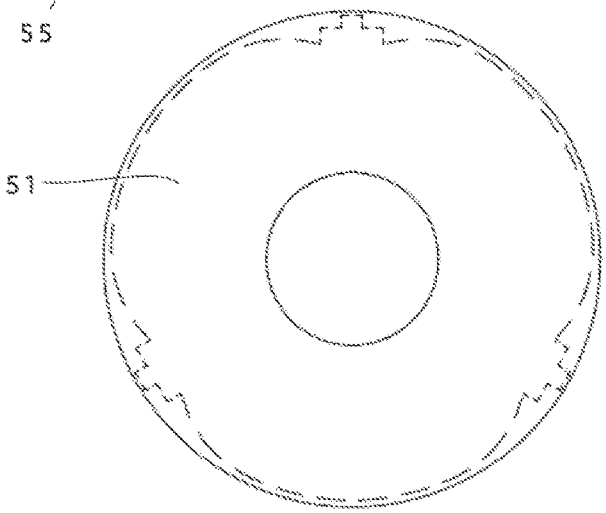

Referring additionally to FIGS. 4*a* to 4*c* the rear housing 20 includes ports "A" and "B" that provide inlets and outlets for hydraulic fluid to the motor 10 to facilitate clockwise and anticlockwise rotation of the rotor 16 and the shaft 18. The rear housing 20, the intermediate rotor housing 24 and the front housing 22 are adapted to be coupled by fasteners 26 that are passed through corresponding apertures 28 as best shown in FIG. 3.

The rear housing 20 includes a surface 30 against which a thrust plate 32, shown best in FIGS. 5*a* to 5*d*, is located. The thrust plate 32 being between the rotor 16 and the rear housing 20. It is noted that the same thrust plate 32 is used as both the rear and front thrust plate and are annotated as 32*a* and 32*b*, respectively. An annular groove 42 is provided about the surface 30 to locate an O-ring seal 44.

The rear housing 20 also contains a blind hole 52 that houses a bush 54, shown in FIG. 3, that in turn supports the rear end of the shaft 18. The surface 30 further includes recesses 31 with central lubrication apertures 35 to located elastomer rings 33 against which the thrust plate 32 bears. These recesses 31 are designed to push the thrust plate 32 against the rotor 16 to help maintain a seal at the sides of the rotor 16. Diagonally opposite recesses are at the same pressures, so the thrust plate is evenly pushed against the rotor.

The A & B ports may be drilled into the rear housing 20 and allow the insertion of fittings (not shown) to provide hydraulic fluid into drilled galleries 48. The A or B port receives flow from a pump and the A or B port returns flow to a tank (not shown) such that the motor 10 may operate in forwards or reverse.

The A port in this 3-lobe example directs flow to ports A1, A2 and A3 which in turn direct flow to respective ports A11, A21, A31 of the rotor housing 24 and then to a particular side of the lobes 15 as is further detail below. The B port in this example directs flow to ports B1, B2 and B3 which in turn direct flow to respective ports B11, B21 and B31 of the rotor housing 24 and then to an opposing side of the lobes 15, as shown best FIGS. 6*a* and 6*b*.

Thrust Plate

Figure 6A:
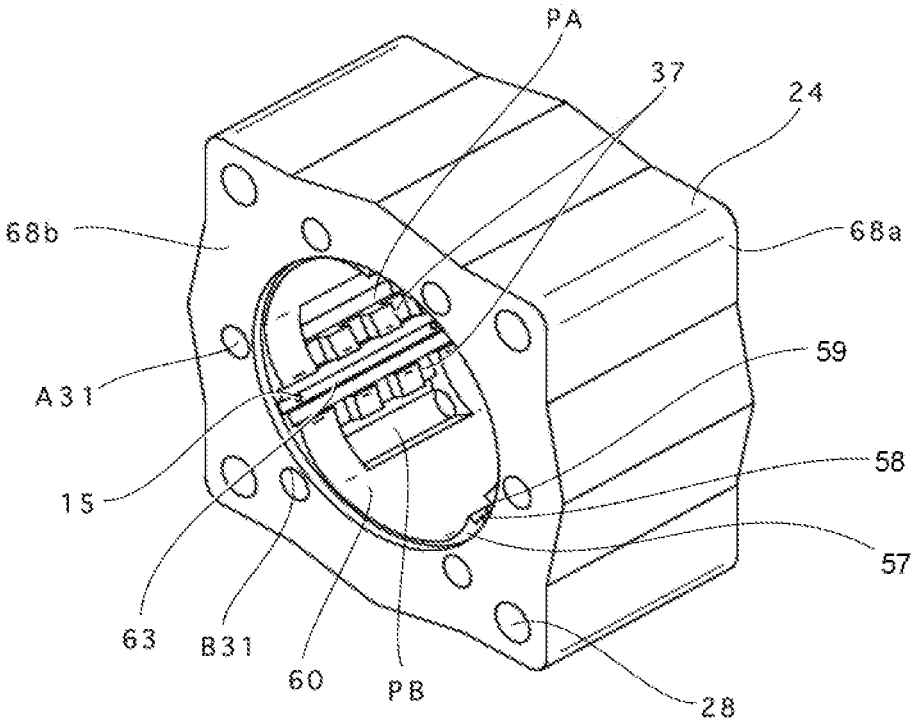
FIGS. 6*a* and 6*b* respectively illustrate a rear perspective view and a rear view of a rotor housing of the motor.

Referring now to FIGS. 5*a* to 5*d*, the thrust plate 32 includes outer face 51 and an inner face 43 the [C1] faces the rotor housing 24. The front face 51 is generally flat and the rear face 43 includes a step 53 and locators 55 that inter-fit with the respective steps 57 and locator 59 of the rotor housing 24 as shown in FIG. 6*a*, provided in this example by the shape of the insert recesses 58, thereby locking the thrust plate 32 against rotation. As aforesaid, the same thrust plate 32 is used as both the rear and front thrust plate and are annotated as 32*a* and 32*b*, respectively.

Intermediate Rotor Housing & Inserts

Figure 6B:
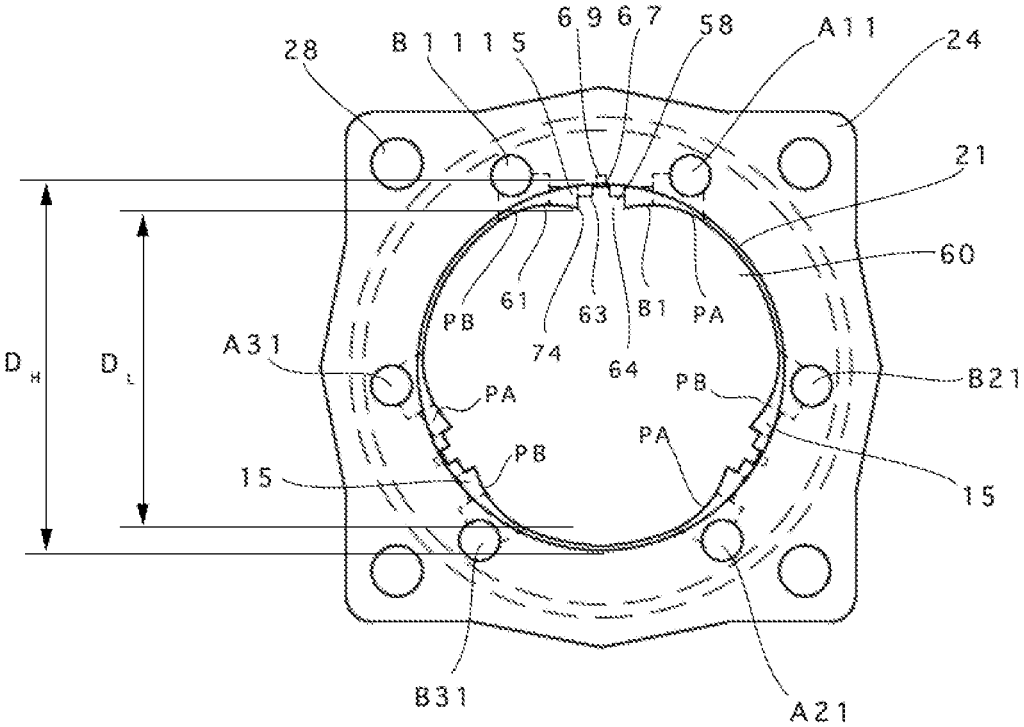

Referring additionally to FIGS. 6*a* and 6*b*, and FIGS. 7*a* to 8*b*, the intermediate rotor housing 24 includes an annular bore 60 that defines the inner circumferential surface 21 with the lobes 15 extending therefrom. In this example, there are three lobes 15 and each of lobes 15 receives inserts 76 within the insert recesses 58 thereof that form a seal between the rotor 16 and the rotor housing 24. In operation, the intermediate rotor housing 24 does not rotate thereby acting as a stator. i.e. it remains in a fixed position relative to the device in which the motor 10 is attached. The rotor housing 24 provides a fixed object for the rotor 16 to react-off to produce rotation. In FIGS. 6*a* and 6*b*, the inserts 76 are removed for clarity.

The rotor housing 24 has a front face 68*a* and a rear face 68*b*. The rear face 68*b* includes ports A11, A21, A31 and ports B11, B21 and B31 that communicate with internal inlet and outlet ports PA and PB. A plurality of thru mounting holes 28 are provided through the rotor housing 24 between the front face 68*a* and a rear face 68*b*. The fasteners 26 pass through the mounting holes 28 to secure the parts together and ultimately seal the working chambers 70.

The lobes 15 include ramps 61 on opposing sides of insert recesses 58 in the form of a slot 63 in which the insert 76 is fitted. On opposing sides of the insert 76 and between the ramps 61 are provided in inlet/outlet ports PA and PB that are in fluid communication with the corresponding ports A and B, as appropriate. The slot 63 includes a mouth section 64 leading to a narrower section 67. The slot 63 includes apertures 69 to receive springs 78 arranged to outwardly bias the insert 76 toward the rotor 16.

The inlet/outlet ports PA and PB include pressure relieving grooves 37. The pressure relieving grooves 37 extend to the slot 63 adjacent the insert 76. The pressure relieving grooves 37 allows for escape of any trapped fluid between the lobes 15 and the followers 23 as they retract.

The rotor housing 24 may be made from ductile steel with sufficient yield strength to contain the high pressure, and also provide a low friction material for the followers 23 to slide across. The displacement or the motor is largely determined by the annulus volume between the diameter $D_H$ of the housing bore 60, the diameter "Dr" of the rotor and the number of lobes 15.

In this example, the tips 74 of the lobes 15 include the recesses 58 that are shaped to receive the inserts 76, shown in FIGS. 8*a* to 8*e*, that form a seal between the rotor 16 and the rotor housing 24. In this example, the inserts 76 are T-shaped having a wider head 91 and a stem 93. The inserts 76 are outwardly biased using springs 78 (shown in FIG. 3) to ensure a seal is maintained between the rotor 16 and rotor housing 24 in the event of wear. A lubrication aperture or passage 79 and side cut-outs or passages 87 ensures the insert 76 remains hydrostatically balanced on opposing inner and outer sides thereby preventing the inserts 76 placing excessive pressure on the rotor 16 that would result in excessive wear.

Figure 11A:
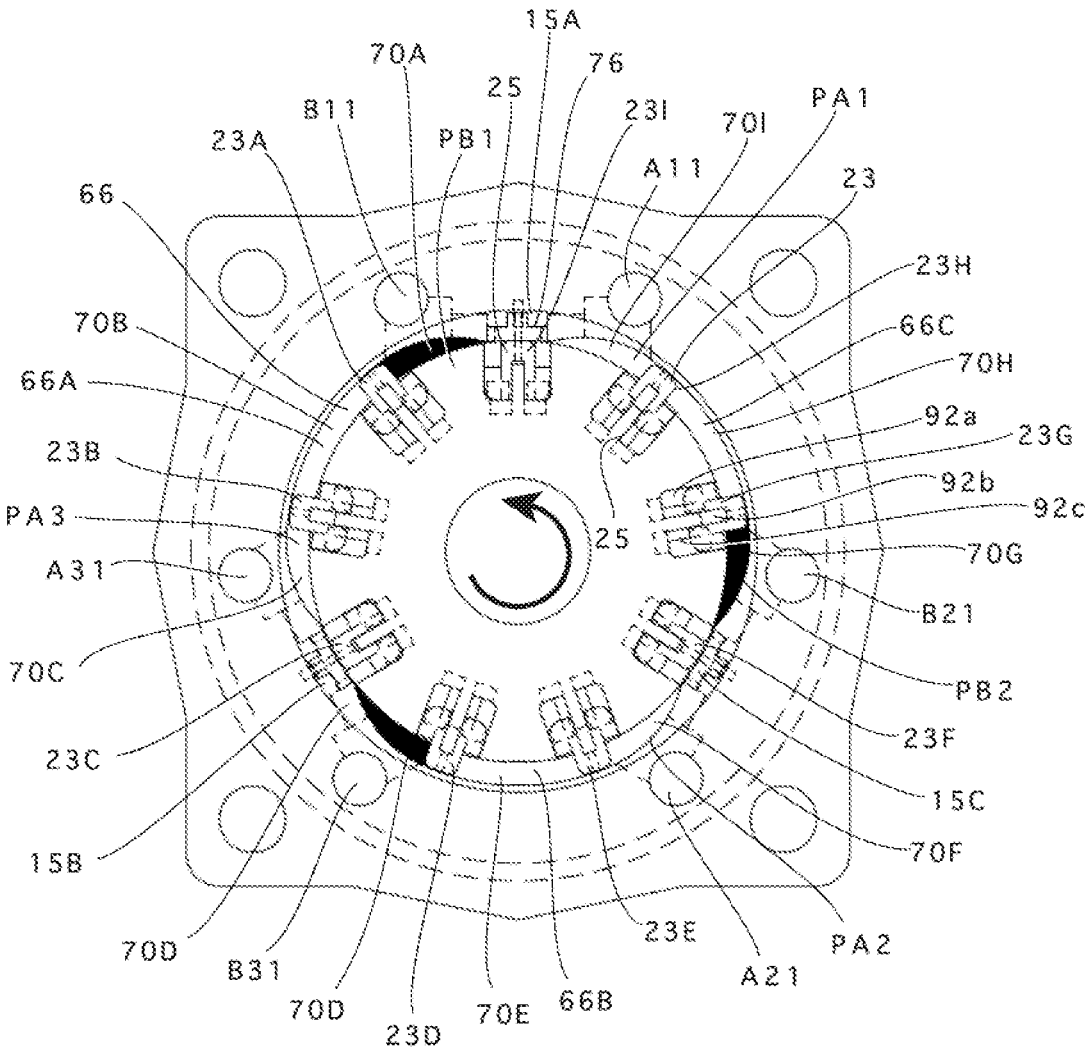
FIGS. 11*a* and 11*b* are functional rotational views illustrating the rotor within the rotor housing moving through the angles of 0 and 20 degrees in an anti-clockwise direction.

It is noted that, preferably, the head 91 of the insert 76 is wider, in a circumferential direction, than a head 86 of the follower 23 as best shown in FIG. 11*a*. This ensures that the insert 76 always remains in contact with outer circumferential surface 19 of rotor 16 which ensures a seal is maintained therewith. The width of the insert 76 also ensures that the insert 76 does not move proud of the lobes 15 as the rotors 16 pass the lobes 15.

Figure 8A:
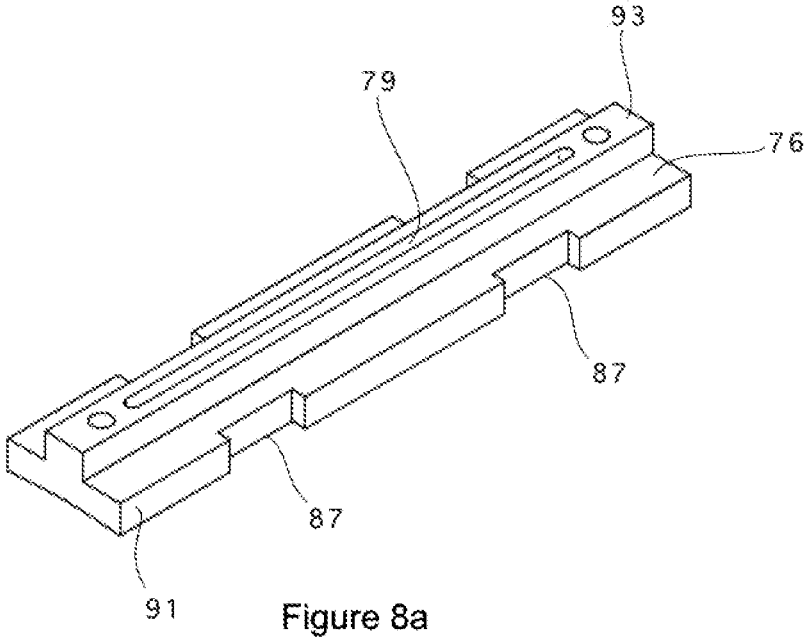
FIGS. 8*a* to 8*e* respectively illustrate a topside isometric view, a bottom isometric view, a side hidden detail view, a top hidden detail view and an end hidden detail view of an insert of the rotor housing.
Figure 8B:
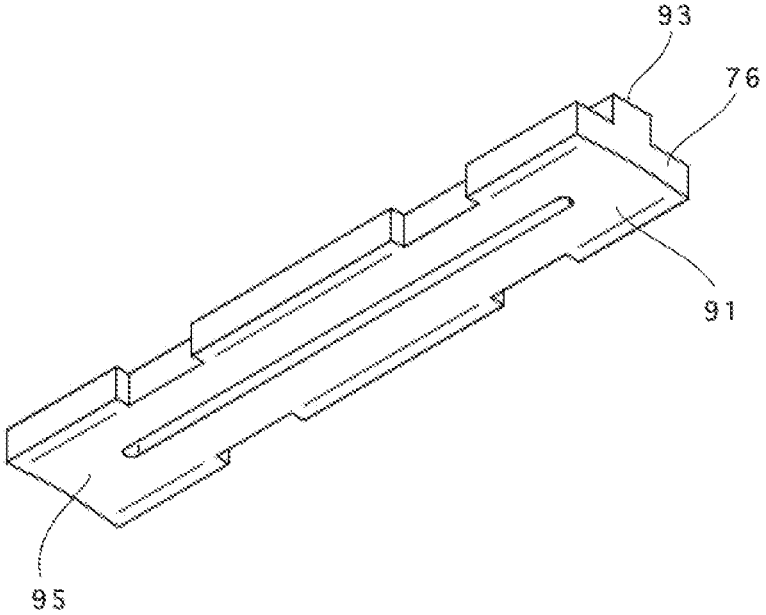
Figure 8C:
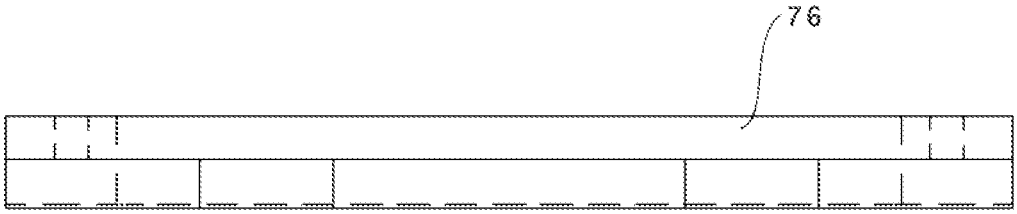
Figure 8D:
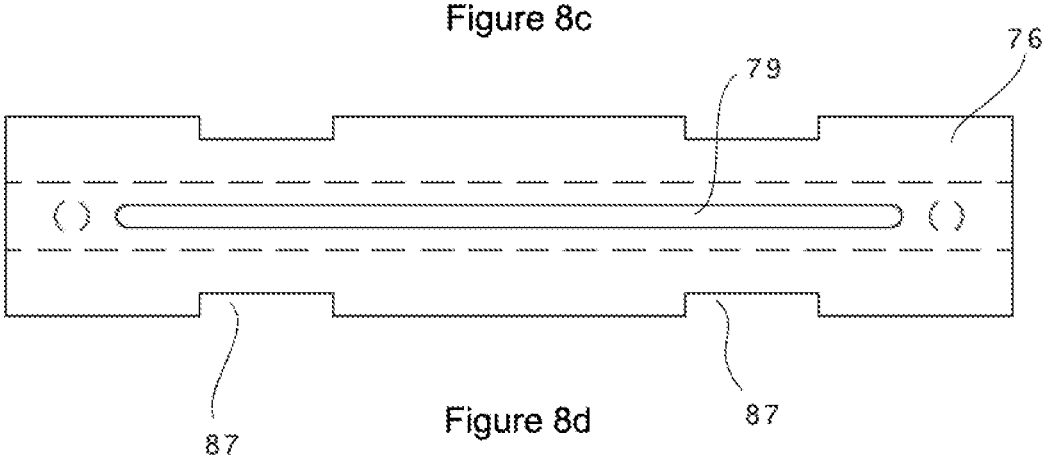
Figure 8E:
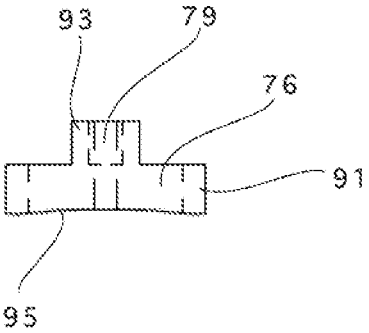

Further, due to the width of the head 91 the contacting surface 95 of the head 91 is curved to generally correspond with the curve of the rotor 16 radius as best shown in FIG. 8*e*. The inserts 76 may be made of a softer material than the rotor housing 26 and are designed to wear over time.

The insert contact surface 95 is radiused to match the rotor radius. However, at the edge of the insert 76 the radius is different, the edges are essentially rounded, so the edges sit off the rotor. This should facilitate the sliding of the follower 23 as they move from the rotor housing surface 21 to the insert surface 95.

As with the follower 23, during further development the need may arise to allow a pilot pressure at operating pressure to act on the centre underside surface of the insert 76. This would ensure the insert 76 was always positively held or biased against the rotor surface 19. This would eliminate the need for the centre slot 79.

Rotor

Figure 7A:
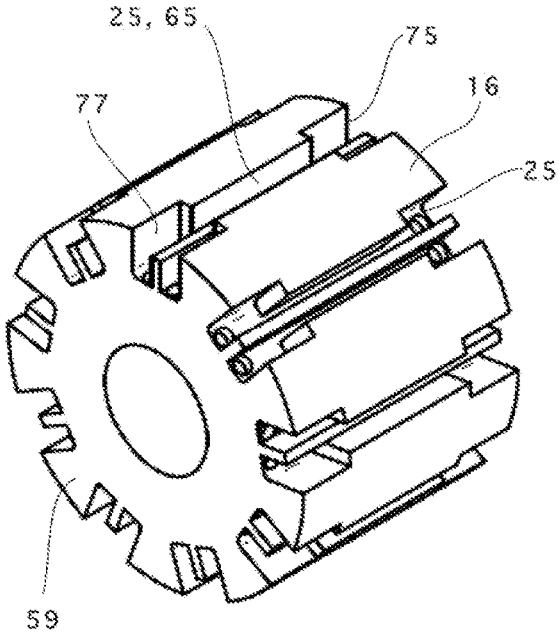
FIGS. 7*a* to 7*c* respectively illustrate front and rear side views of a rotor of the motor.
Figure 7B:
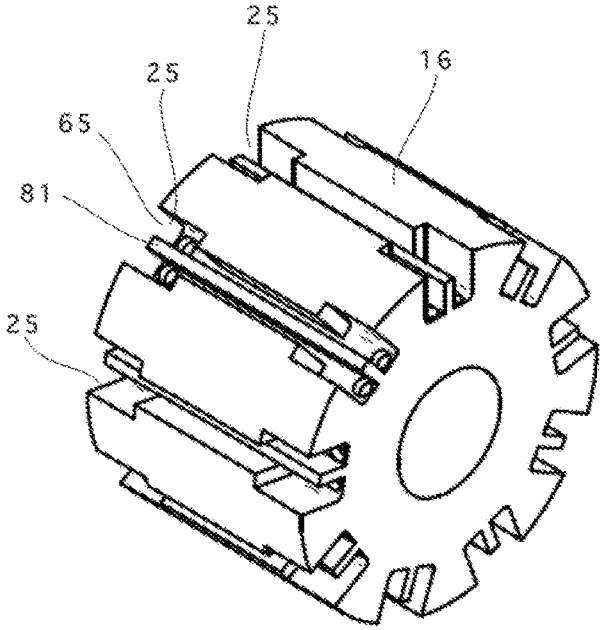
Figure 7C:
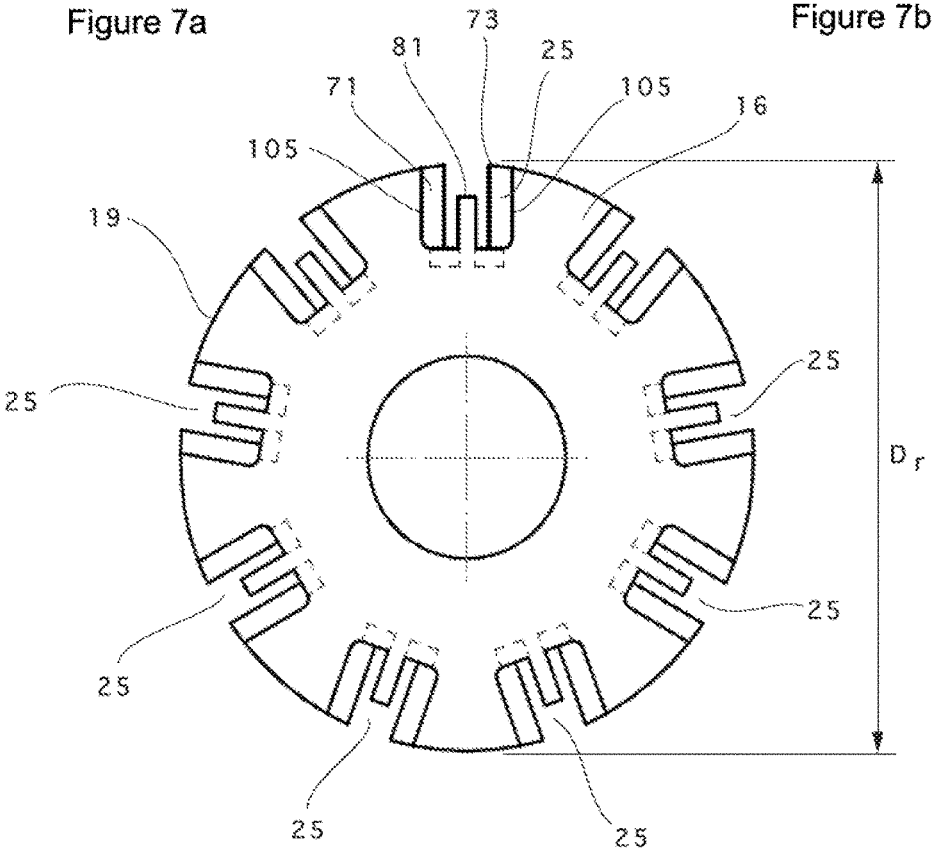
Figure 11B:
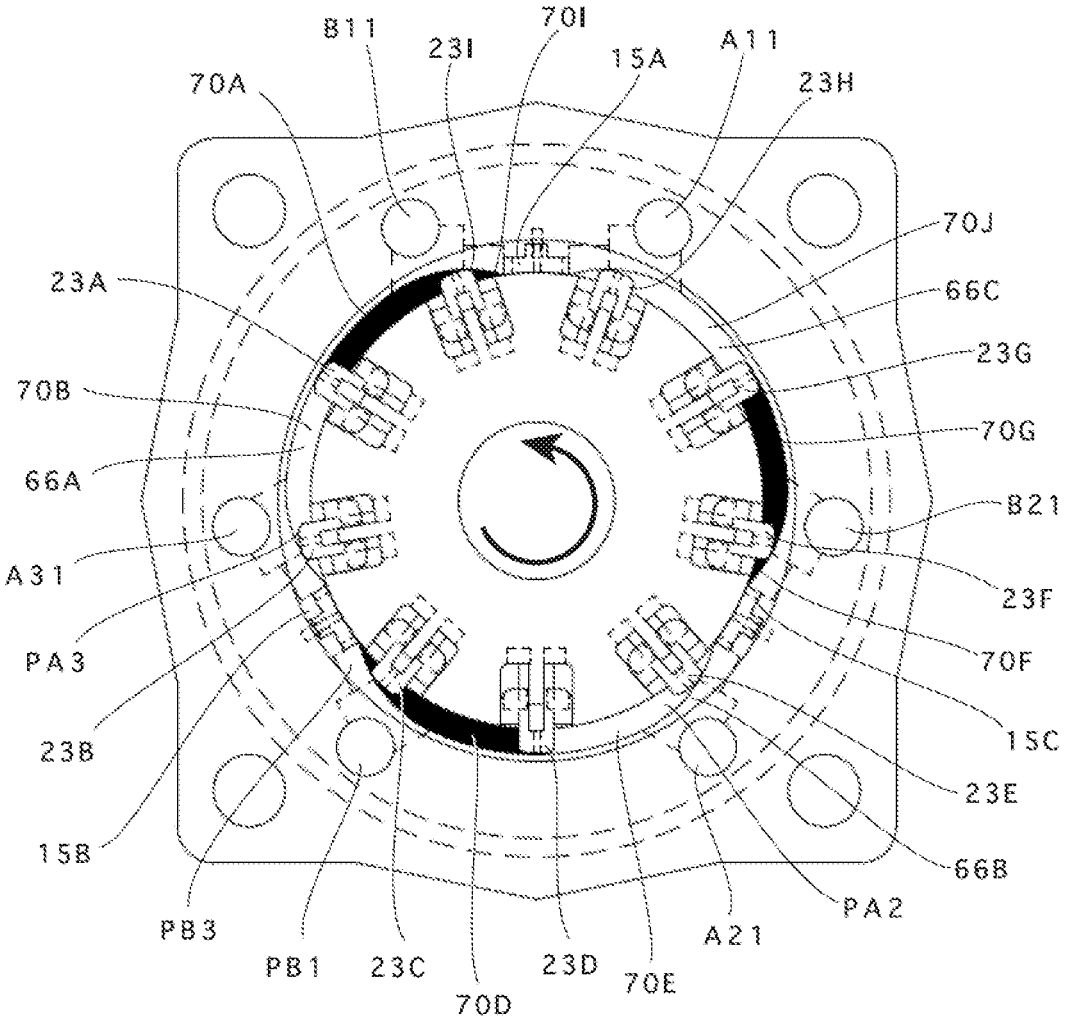
Figure 12A:
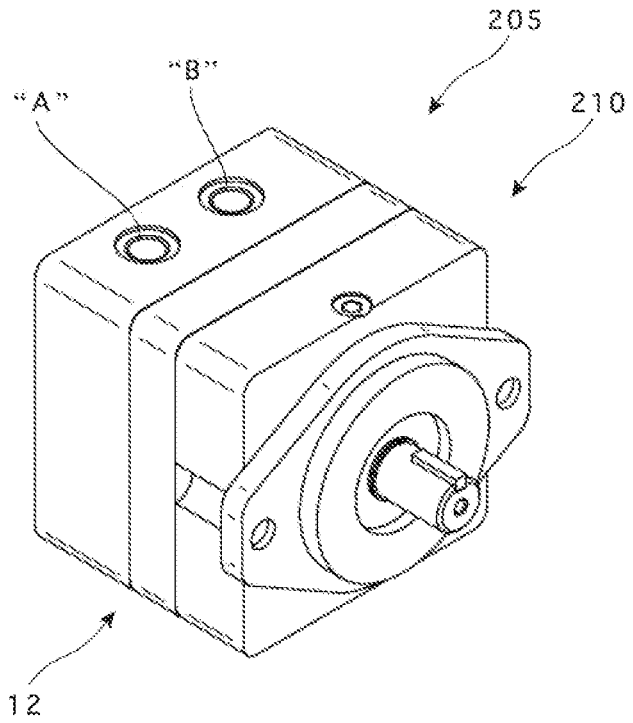
FIGS. 12*a* and 12*b* are isometric topside and bottom side views illustrating a second example of a rotary fluid device in the form of a rotary hydraulic motor.
Figure 12B:
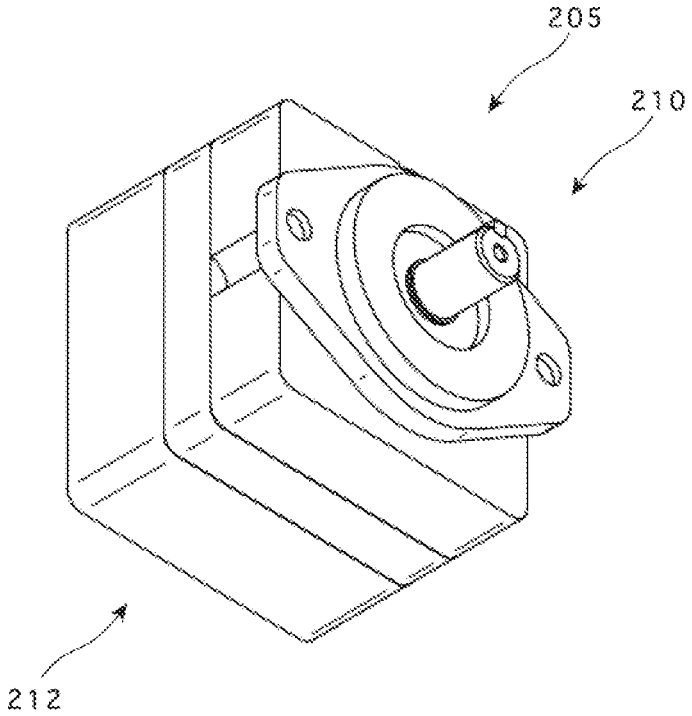
Figure 13A:
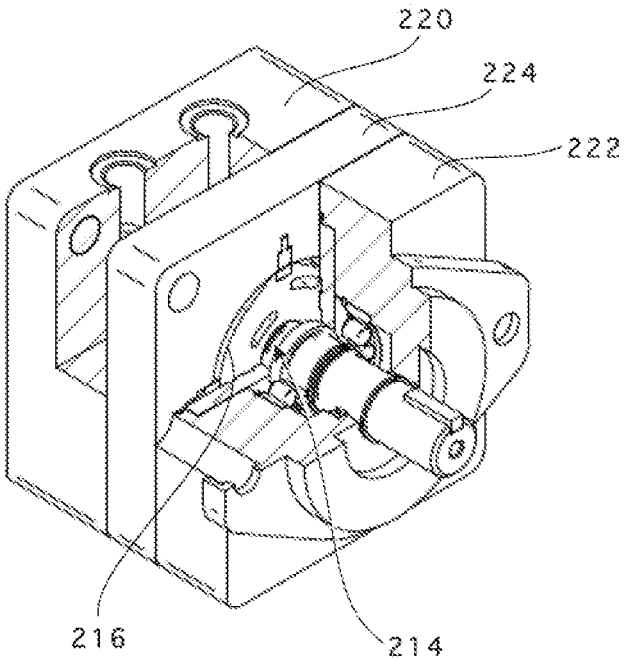
FIGS. 13*a*, 13*b* and 13*c* are sequence of isometric cut-away views illustrating the internal arrangement of the motor with progressive removal of parts to aid clarity.
Figure 13B:
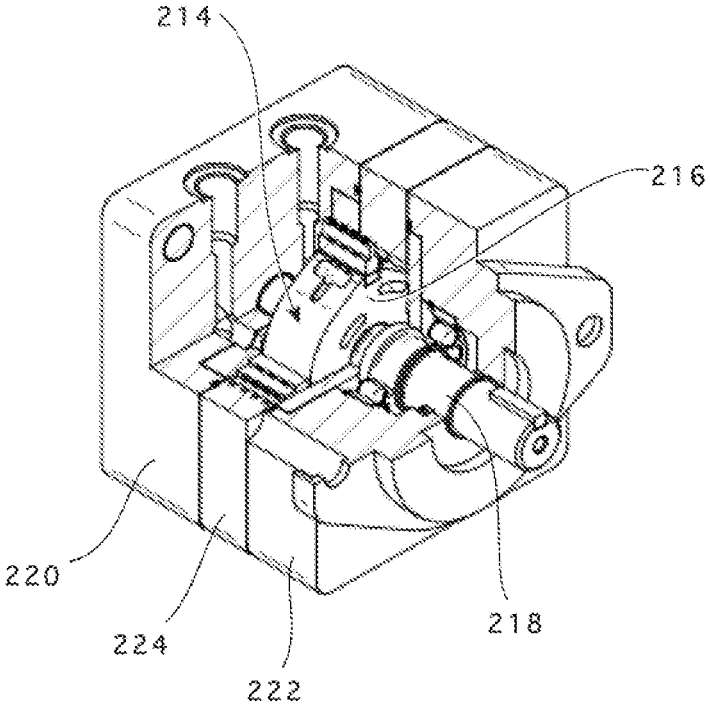
Figure 13C:
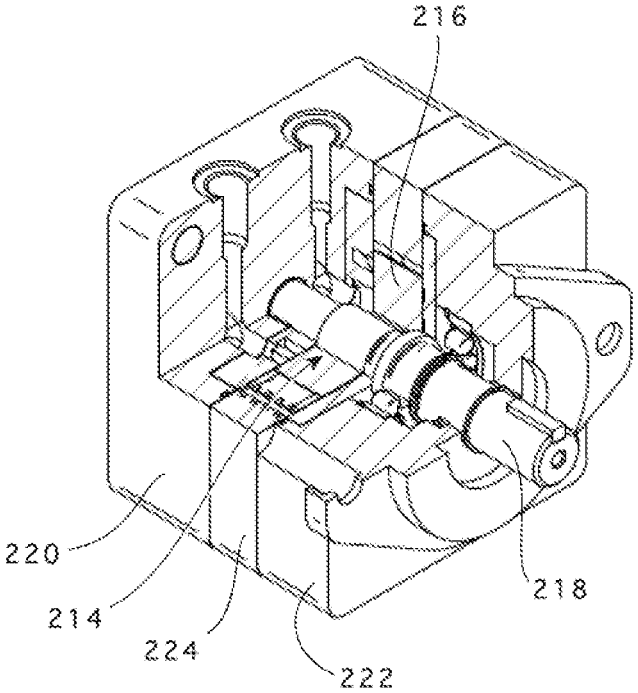
Figure 14A:
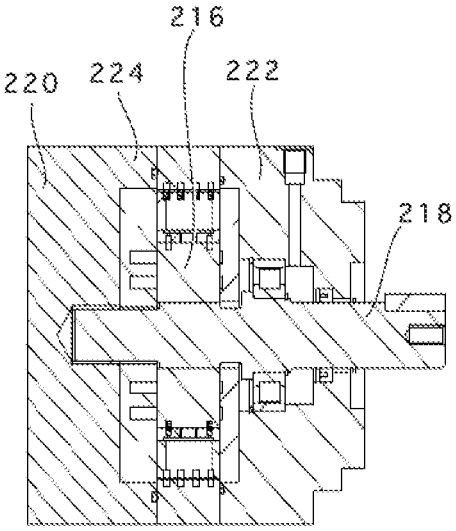
FIGS. 14*a* and 14*b* are cross sectional side and top views illustrating the motor.
Figure 14B:
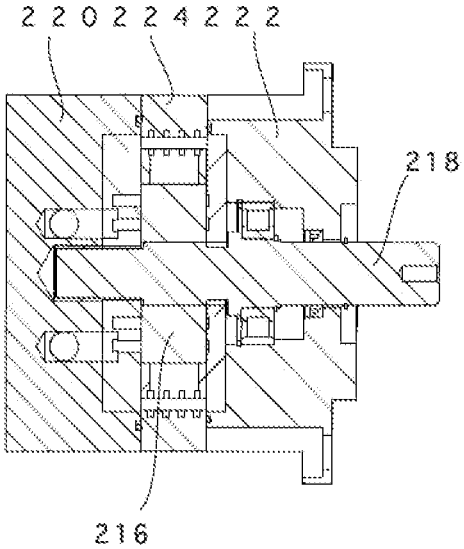

Referring to FIGS. 7*a* to 7*c* the rotor 16 is shown with the followers 23 removed. The rotor 16 has a cylindrical body 59 with the follower recesses 25 arranged to allow linear extension and retraction of the followers 23. The diameter "Dr" of the rotor 16 is about equal to the diameter "DL" of the rotor housing 24 at the lobes 15. The remaining diameter "Dr" of the rotor 16 is less than the diameter "$D_H$" of the annular bore 60 of the rotor housing 24 such that the followers 23 divide the troughs 66 to provide pressure chambers 70 (i.e. Chambers 70A, 70B, etc. as shown in FIGS. 11*a* and 11*b*) between the lobes 15, followers 23, the rotor 16 and the rotor housing 24.

In this example, the follower recesses 25 are provided in the form of machined radially extending slots 65 which have a first side 71, a second side 73 and a rib 81 extending between and dividing the first side 71 and second side 73. The relative height of the rib 81 is lower than the outer circumferential surface 19 of the rotor 16, and the opposing ends 77 of the follower recesses 25 are enlarged to fit with the followers 23 and accommodate biasing elements 79 in the form of springs 88 to outwardly urge the follower 23.

It is noted that it is possible to have any number of a plurality of lobes 15 and followers 23. The more lobes 15 that can be fitted in within physical limits, the higher the displacement of the motor 10 for a given size.

Followers

Turning now to the followers 23 in more detail and referring additionally to FIGS. 9*a* to 9*d*, the followers 23, sometimes also referred to as vanes or cam followers, function as seals between the chambers 70 at working pressure (e.g. positive pressure Chamber 70A and at return pressure Chamber 70C as shown in, for example, FIG. 11*a*). The followers 23 also provide side surfaces 29 against which the rotor 16 is able to react to generate rotation. The followers 23 are slidably fitted at least partially within follower recesses 25 of the rotor 16 so as to move only in a radial direction to and from the follower recesses 25, and the fit is such that any rotation or lateral movement of the followers 23 is inhibited.

It is preferable to have at least two followers 23 for each lobe 15. In this example, most preferably, there are three followers 23 for each lobe 15 which allows at least one follower 23 to be in contact with the minimum radius of the rotor housing 24 whilst the other two adjacent followers 23 are located within the troughs 66 between the lobes 15. Likewise, in this arrangement, at least one of the followers 23 is positioned to extend across the widest part of the troughs 66 and inhibit flow between the inlet and outlet ports PA, and PB.

This ensures the pressure or inlet ports PA of the preceding lobe 15 are not connected via the troughs 66 through to the tank or outlet ports PB of the next lobe 15, as shown in FIGS. 11*a* and 11*b*. In other words, the followers 23 divide the troughs 66 between the lobes 15 to create the chambers 70 (annotated as chambers 70A to 701) providing a seal between adjacent ports PA, PB. The followers 23 have radii on the leading and trailing edges 84, 85 to ensure smooth retraction and extension of the followers 23.

The followers 23 are urged toward the inner circumferential surface 21 of the rotor housing 24 via a bias in the form of springs 88 between the followers 23 and the follower recess 25 of the rotor housing 24. Accordingly, in use, the followers 23 generally "follow" the inner circumferential surface 21 of the rotor housing 24 as the rotor 16 is rotated, and extend and retract to follow the lobes 15 and troughs 66 therebetween. To reduce scoring of the inner circumferential surface 21 of the rotor housing 24, the followers 23 may be made of a softer material in comparison to the rotor housing 24 such as brass or bronze or other suitable material.

Figure 9A:
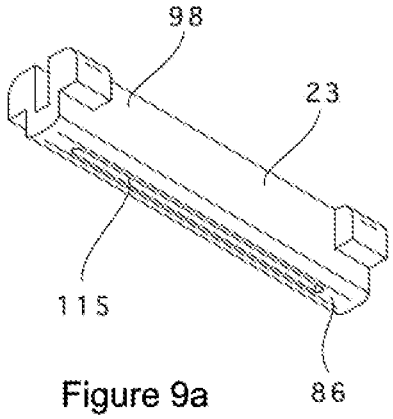
FIGS. 9*a* to 9*d* respectively illustrate an outer side isometric view, an inner side second isometric view, an end hidden detail view and top hidden detail view of a follower.
Figure 9B:
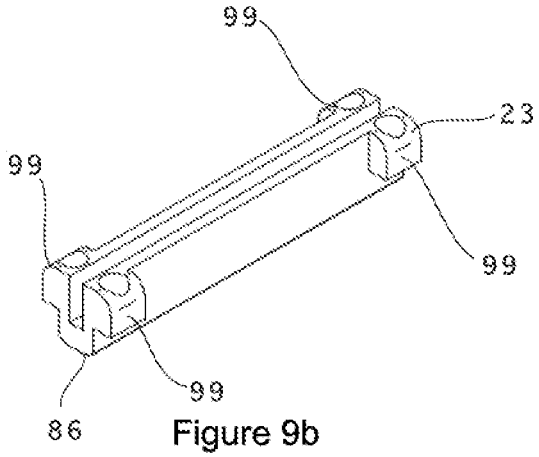
Figure 9C:
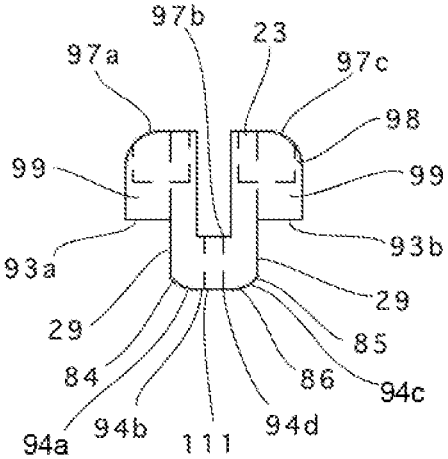
Figure 9D:
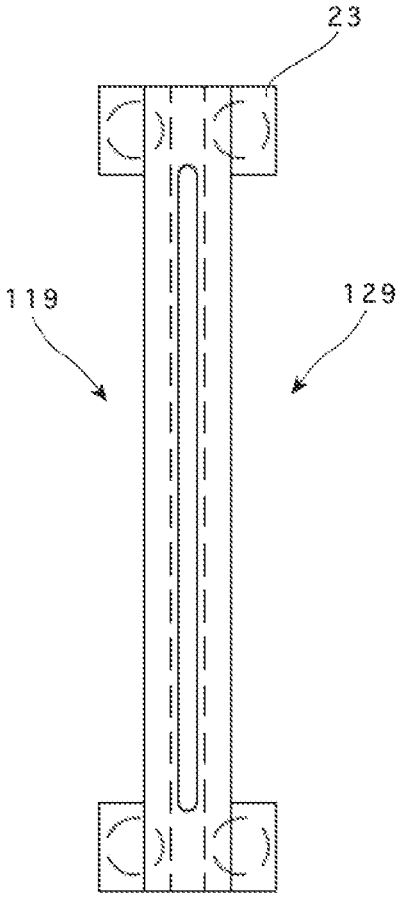

In more detail, as best shown in FIG. 9*c*, the followers 23 include a head portion 86, a wider base portion 98 and an aperture 111 in the form of an internal slot 115 that extends from the base portion 98 toward the head portion 86. A gap defined by the internal slot 115 receives the rib 81 of the follower recess 25 and the base portion 98 includes locators 99 at opposing ends thereof that fit with the follower recesses 25 and receive and hold the springs 88.

The head portion 86 includes three upper or top facing surfaces 94*a*, 94*b* and 94*c* and the base portion includes upper or top facing surfaces 93*a* and 93*b* that generally face away from the follower recess 25 toward the chambers 70 and three opposing underside or bottom surfaces 97*a*, 97*b* and 97*c* that face the follower recesses 25. As shown in FIG. 9*c*, it is noted that surfaces 94*a* and 94*c* are generally provided on the radiused edges 84 and 85, and the surface 94*b* is between the surfaces 94*a* and 94*c* and provides a tip surface 94*d*.

To minimize friction, the hydraulic fluid may act as a lubricant between the inner circumferential surface 21 and the followers 23. The lubricating film in this area will be at pressure, which would ordinarily create an imbalance of forces on the cam follower 23 causing it to retract, and thereby separate from the inner circumferential surface 21 and causing leakage and loss of efficiency.

Accordingly, to counteract this pressure imbalance, the aperture 111 allows the movement of fluid to the intermediate pressure zone 92*b* that is located between the underside surface 97*b* of the head portion 86 and the rib 81 as the followers 23 move between extended and retracted conditions. This allows the followers 23 to remain lubricated and also generally hydrostatically balanced. The intermediate pressure zone 92*b* is shown in FIG. 11*a*

The side surfaces 29 of the followers 23 are spaced by the locators 99 from the sides 105 of the follower recesses 25 so as to provide a passage 119 between the upper or top surfaces 94*a*, 94*c* of the locators 99 that face the chamber 70 and opposing underside surfaces 97*a* and 97*c* that face the follower recesses 25.

The passages 119 allow general hydrostatic balancing between any area on the surface of the head 86 that is outside the width of the rib 81 such as the surfaces 93*a* and 93*b* and the upper or top facing surfaces 94*a*, 94*c*, and the underside or bottom facing surfaces 97*a*, 97*c* which defines two further lateral pressure zones 92*a*, 92*c* on opposing sides of the intermediate pressure zone 92*b*. Each pressure zone 92*a*, 92*b* and 92*c* being separate to the other. As such, the three pressure zones may be substantially independent. It is noted that the passage 119 may be an open channel that extends along part of the width of the rotor 16 as is shown in this example or may be an aperture through the follower as shown in the second example below.

It is noted that the three pressure zones 92*a*, 92*b*, 92*c* allow the varying profile on the face (i.e. the leading-edge radii and the head radius to match the rotor housing) that mates with the rotor housing 24 to remain hydrostatically balanced. This ensures that the net force applied to the rotor housing 24*y* the followers 23 is predominately controlled by the springs 88 (or other biasing means, that may include a pilot pressure). It is noted that interchanging the springs 88 with various spring rates can be used to alter the speed rating of the motor. (i.e stiffer bias springs will hold the follower onto the lobes for longer at higher speeds).

It is noted that in some examples, the intermediate pressure zone 92*b* may be provided with a pilot pressure. The pilot pressure may be communicated via a pilot conduit (not shown) within the rotor housing 24 from the operating port to the intermediate pressure zone 92*b*. The pilot pressure may be a positive pressure acting to outwardly bias the followers 23 thereby providing a further bias in addition to the springs. A similar arrangement may be used for the insert 76. In this arrangement, the intermediate pressure zone 92*b* is not hydrostatically balanced with the pressure at the tip surface 94*d*. However, the three pressure zones still exist 92*a*, 92*b*, 92*c*— with the intermediate pressure zone 92*b* in effect providing a bias.

It is noted that in this arrangement, the centre aperture 111 of the followers 23 would be eliminated and the operating pilot pressure would be directed to act on the surface 97*b* of the centre section of the follower 23. In this situation the tip surface 94*d* would not necessarily be radiused to match the surface of the rotor housing 24. This means that the contact point would be much smaller which is the case with many existing vane motors and vane pumps.

Front Housing

Figure 10A:
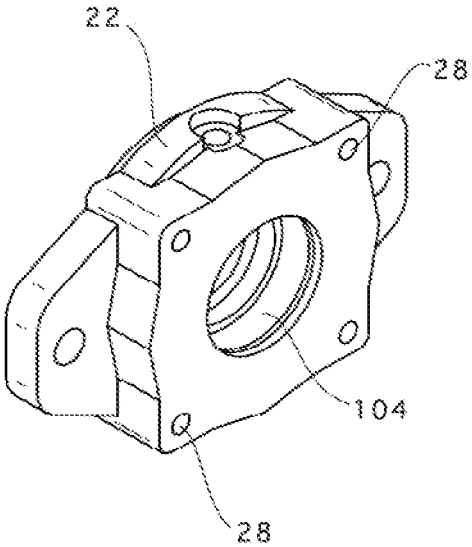
FIGS. 10*a* to 10*c* respectively illustrate a rear isometric view, a front isometric view and a top sectional view of a front housing of the motor.
Figure 10B:
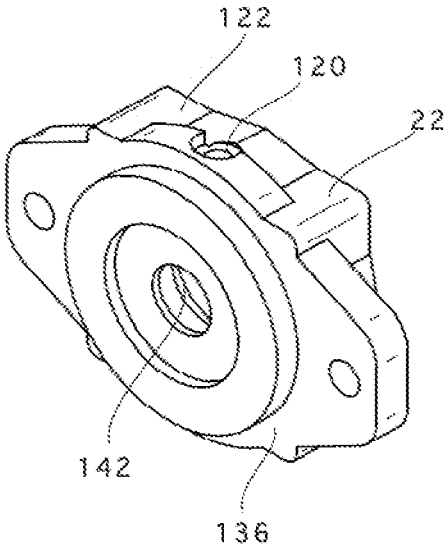
Figure 10C:
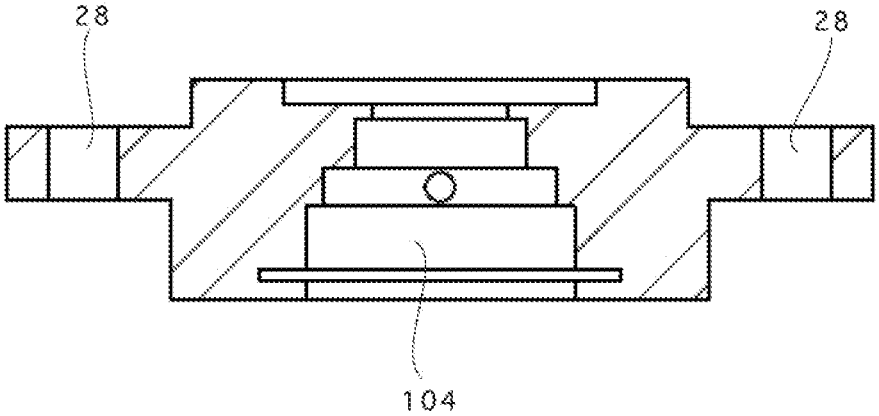

Referring now to FIGS. 10*a* to 10*c*, the front housing 22 may be manufactured from ductile steel. The front housing 22 includes a stepped bore 104 in a bearing 126, a ring 118 and a shaft seal 127 are received to rotatably support the shaft 18. The front thrust plate 32*b* sits inside the rotor housing 24.

A threaded drain port 120 is drilled into a top face 122 of the front housing 22 and to allow the insertion of fittings (not shown) which can be adapted to fluid transfer conduits connected to a reservoir at low pressure. The drain port 120 is provided to allow removal of fluid that may have leaked from the pressure chambers 70.

The front housing 22 contains the plurality of threaded apertures 28 which enable it to be clamped to the rotor housing 24 and rear housing 20 via the fasteners 26. The front housing 22 has a front flange 136 that may be a standard SAE mounting configuration to allow easy coupling to the device to be driven by the motor. There is a hole 142 though the length of the front housing 122 to accommodate the shaft 18 and to allow it to protrude out from the front flange 136

Shaft

The shaft 18, shown best in FIG. 3, is elongated and may be manufactured from a hi-tensile steel. The shaft 18 is the means by which the rotation generated by the rotor 16 is transmitted to the device (not shown) being driven. The shaft 18 has a spline 146 machined to mate with a corresponding spline 148 on the inside diameter of the rotor 16. The shaft 18 couples to the device (not shown) to be driven by either the key 128 or spline compatible with the said device. The shaft 18 has various diameters that are at sizes to suit the shaft seal 127 and bearing 126 and to also allow assembly and free rotation during operation.

Use and Operation

Referring now to FIGS. 11*a* to 11*b*, an example of the rotation of the motor 10 is shown through 20 degrees to explain the movement of the hydraulic fluid, rotor 16 and followers 23. It is noted that an anti-clockwise sequence is shown for example purposes only and the direction of rotation can be reversed by reversing the direction of flow from the inlet A and outlet B ports. The motor 10 may be connected via inlet and outlet ports A and B to pressurise hydraulic fluid supply and a return tank that is at relatively lower pressure.

Referring to FIG. 11*a* at zero degrees rotation a pressurised hydraulic fluid is supplied to ports B11, B21 and B31 and to the respective internal ports PB1, PB2, PB3. This creates a high pressure on the side faces 29 of the adjacent followers 23A, 23D and 23G. It is noted that the nine followers 23 are marked as 23A to 231, the nine defined chambers 70 are marked as 70A to 701, the three lobes 15 are marked as 15A, 15B and 15C and the three troughs 66 between the three lobes 15 are marked as 66A, 66B and 66C for explanatory purposes.

Followers 231, 23C and 23F are in a retracted condition at lobes 15A, 15B and 15C respectively to seal the now pressurised chambers 70A, 70D and 70G. The remaining followers 23 are in an extended condition as they travel through the defined troughs 66A, 66B and 66C between the lobes 15A, 15B, and 15C. The internal ports PA1, PA2 and PA3 are open to allow fluid to egress form chambers 701, 70C and 70F that facilitates ongoing rotation of the motor 10.

Referring now to FIG. 11*b*, the rotor 16 is shown rotated 20 degrees counter-clockwise in comparison on FIG. 11*a*. The pressure is continued to be applied via internal ports PB1, PB2, PB3 on the side faces 29 of the adjacent followers 23A, 23D and 23G via chambers 70A, 70D and 70G, and now also part of the next followers 231, 23C and 23F via the chambers 701, 70C and 70F. In FIG. 11*b*, chamber 70J is defined due to the relative position on the lobes 15 and the followers 23.

The rotor 16 continues to rotate with the low-pressure side fluid being egressed from internal ports PA1, PA2 and PA3. The rotor 16 continues its rotation whilst the pressure is applied to Port B. The direction of rotation may be reversed by swapping the pressurised fluid to port A and the exhaust to port B. It is noted that the symmetrical arrangement of the motor 10 allows rotation in either direction.

Second Example 200

Referring now to initially FIGS. 12*a* to 15 there is shown a second example of a rotary fluid device 205 in the form of a rotary hydraulic motor 210.

The hydraulic motor 210 includes an outer housing assembly 212 and an inner rotating arrangement 214 adapted to rotate relative to the outer housing assembly 212. The inner rotating arrangement 214 includes a rotor 216 and a shaft 218. The outer housing assembly 212 includes a rear housing 220, a front housing 222 and an intermediate rotor housing 224 between the rear housing 220 and the front housing 222 in which the rotor 216 is housed.

In this example, the rotor 216 includes lobes 264 and followers 262 are carried by the intermediate rotor housing 224 which is an inverse configuration relative to the first example described above. However, the general functionality of the motor 210 is similar to the first example as is outlined below.

Rear Housing

Figure 15:
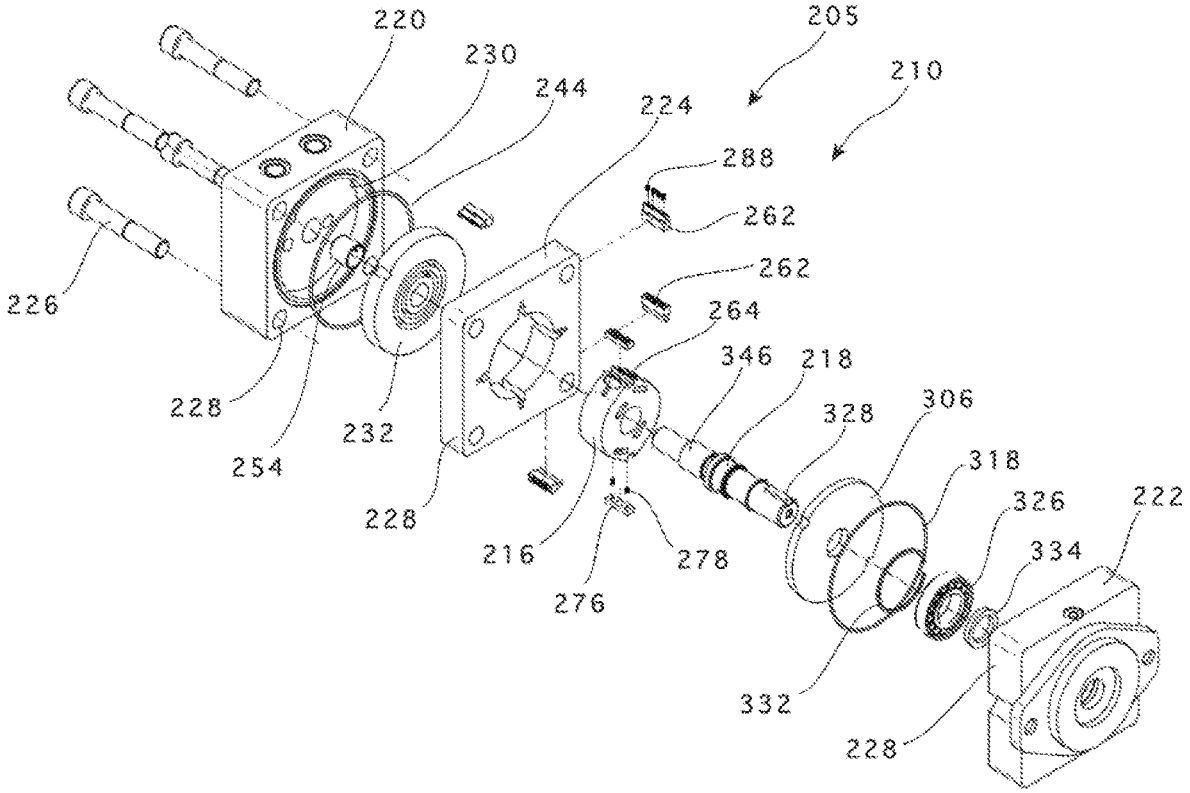
FIG. 15 is an exploded parts view illustrating the motor.
Figure 16A:
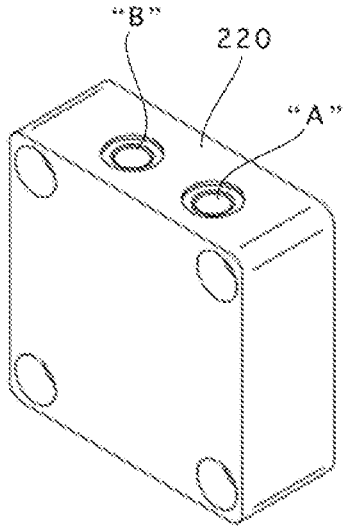
FIGS. 16*a* and 16*b* are isometric rear and front views illustrating a rear housing of the motor.
Figure 16B:
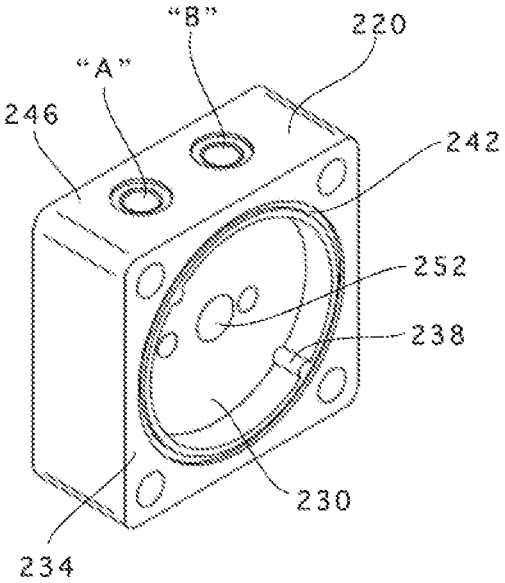
Figure 16C:
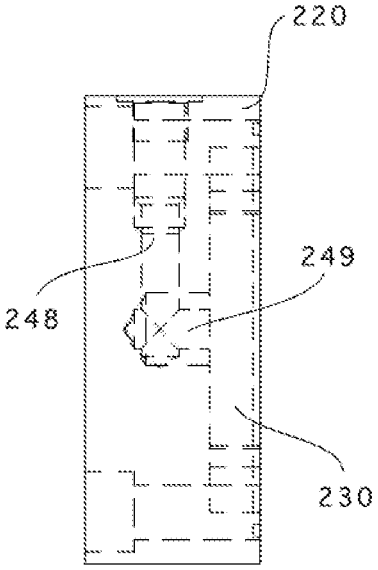
FIGS. 16*c* and 16*d* are side sectional and front views illustrating the rear housing of the motor.
Figure 16D:
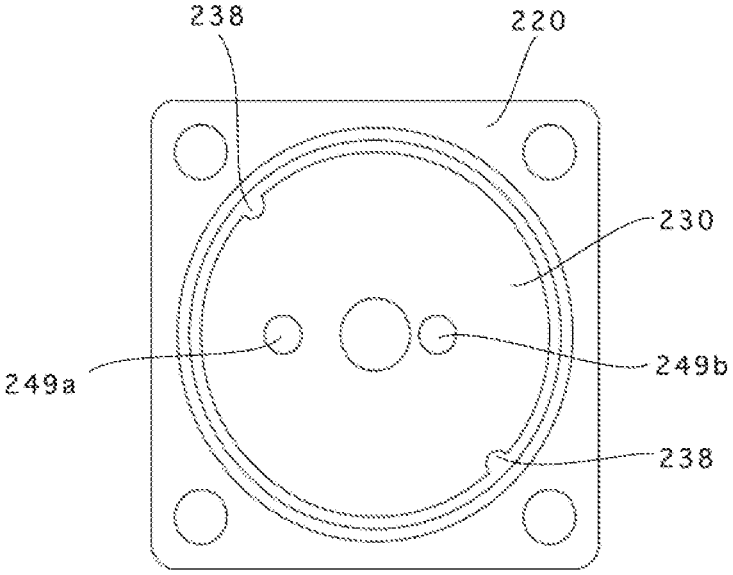

Referring additionally to FIGS. 16*a* to 16*d*, the rear housing 220 includes ports "A" and "B" that provide inlets and outlets for hydraulic fluid to the motor 210 to facilitate clockwise and anticlockwise rotation of the rotor 216 and the shaft 218. The rear housing 220, the intermediate rotor housing 224 and the front housing 222 are adapted to be coupled by fasteners 226 that are passed through corresponding apertures 228 as best shown in FIG. 15.

The rear housing 220 includes a recess 230 in which a rear thrust plate 232, shown best in FIGS. 16*a* to 16*d*, is received. The depth of the recess 230 for the rear thrust plate 232 is such that when the rear thrust plate 232 is fitted to the recess 230, a front face 234 of the rear housing 220 and a front face 236 of the rear thrust plate 232 are substantially flush with one another.

The rear housing 220 has locators in the form of male notches 238 that match with corresponding locators in the form of female grooves 240 of the rear thrust plate 232 ensuring correct assembly. The rear housing 220 includes an annular groove 242 skirting the recess 230 for an elastomer seal 244. The elastomer seal 244 is fitted between the face 234 of the rear housing 220 and the intermediate rotor housing 224, to inhibit leakage of hydraulic fluid to the external environment.

Figure 17A:
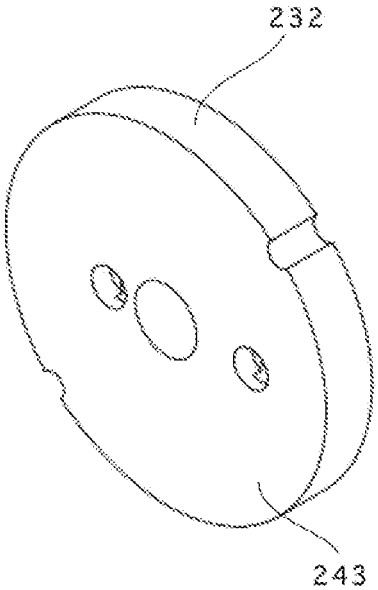
FIGS. 17*a* and 17*b* are isometric rear and front views illustrating a rear thrust plate of the motor.
Figure 17B:
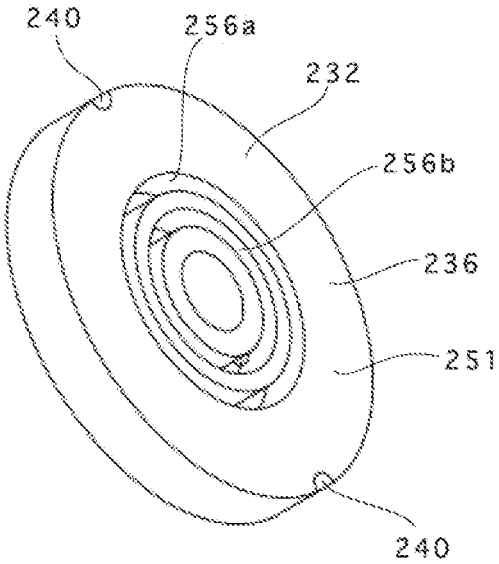
Figure 17C:
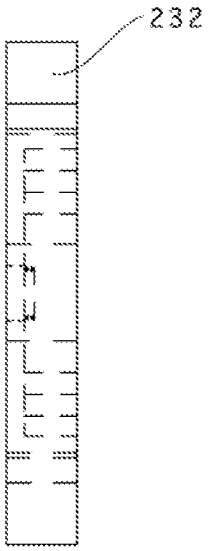
FIGS. 17*c* and 17*d* are side sectional and front views illustrating the rear thrust plate of the motor.
Figure 17D:
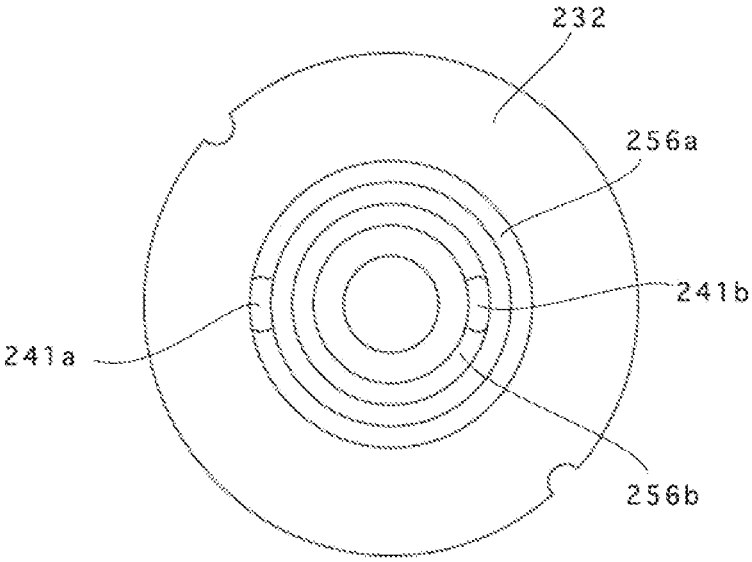
Figure 18A:
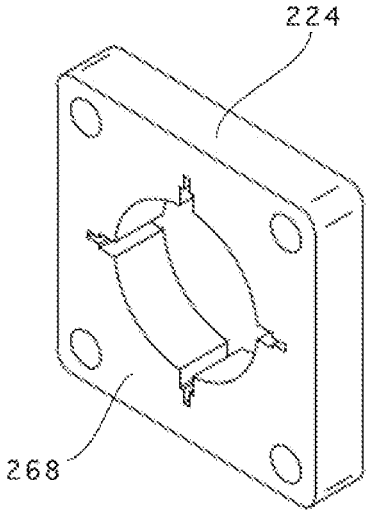
FIGS. 18*a*, 18*b* and 18*c* are front isometric views and a front view illustrating the rotor housing of the motor.
Figure 18B:
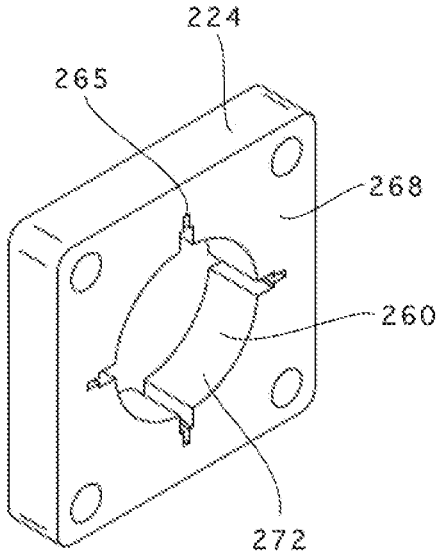
Figure 18C:
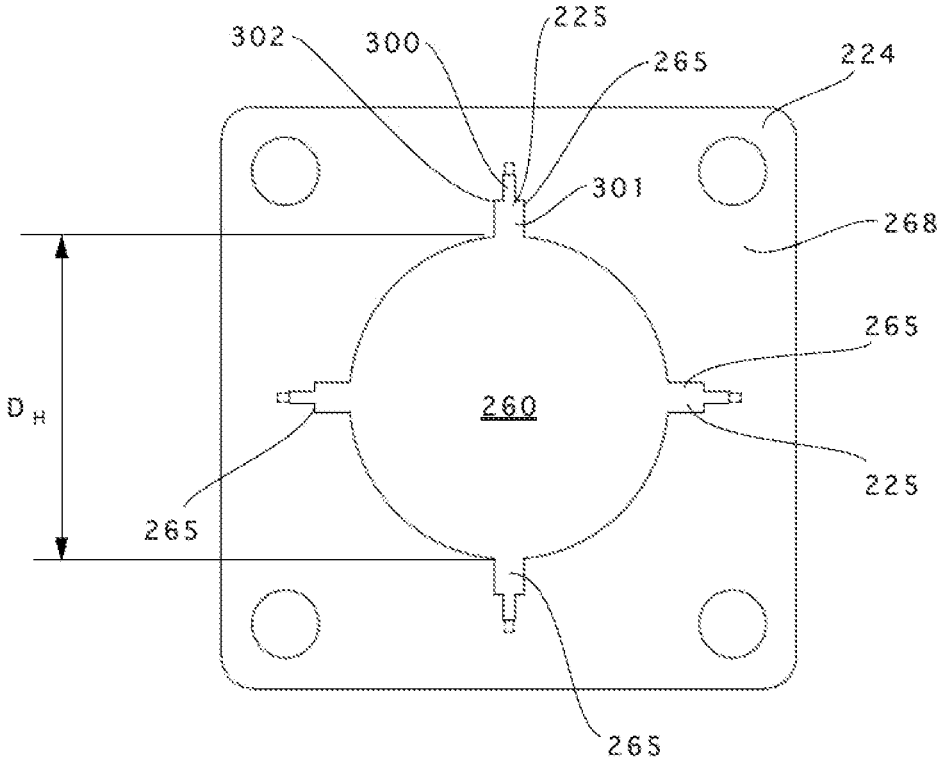
Figure 19A:
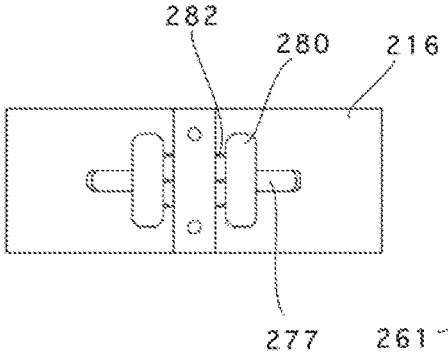
FIGS. 19*a*, 19*b* and 19*c* are top and side isometric views illustrating a rotor of the motor.
Figure 19B:
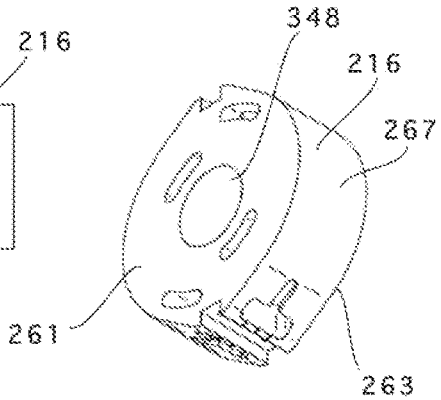
Figure 19C:
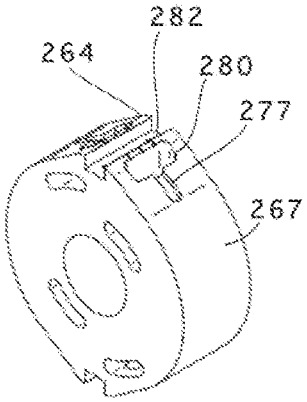
Figure 19D:
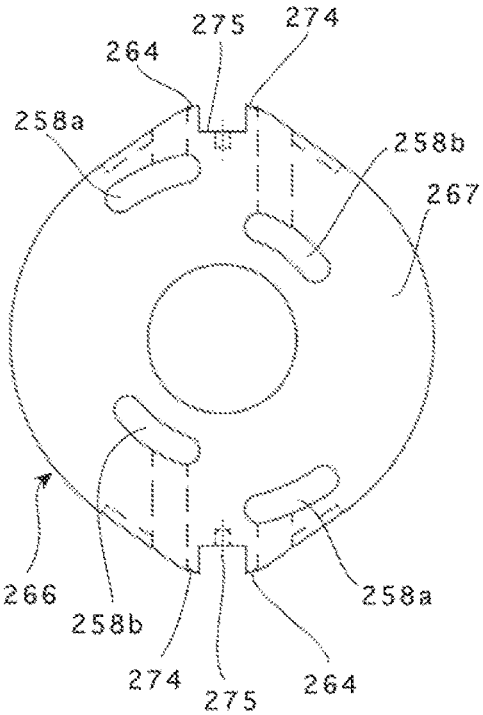
FIGS. 19*d*, 19*e* and 19*f* are front side, side hidden detail and backside views illustrating the rotor of the motor.
Figure 19E:
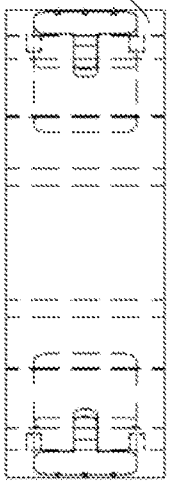
Figure 19F:
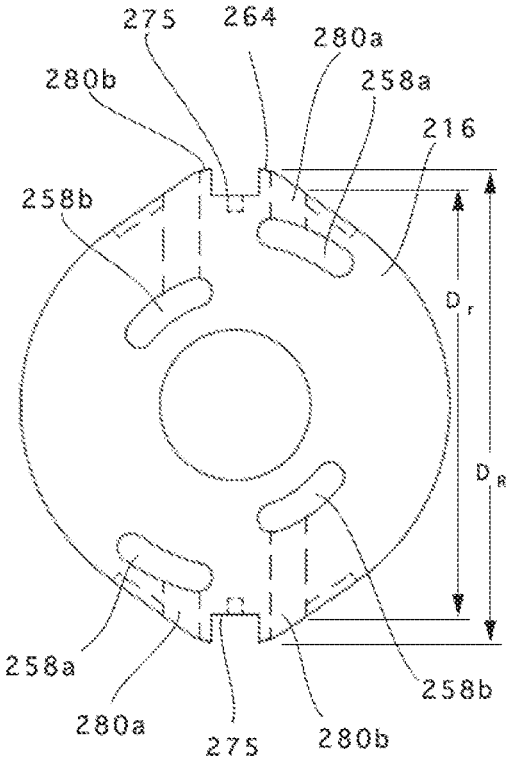
Figure 20A:
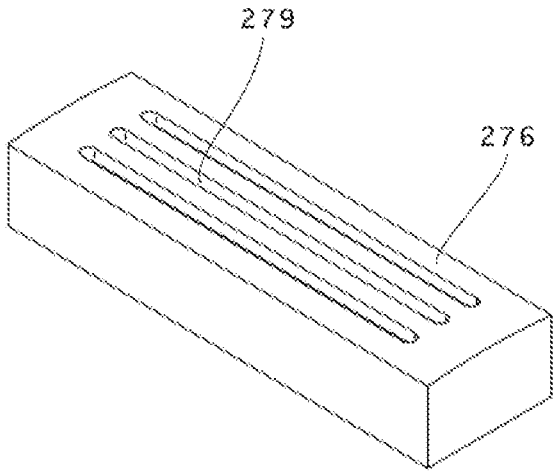
FIGS. 20*a* and 20*b* are topside isometric and bottom side isometric views illustrating an insert of the rotor.
Figure 20B:
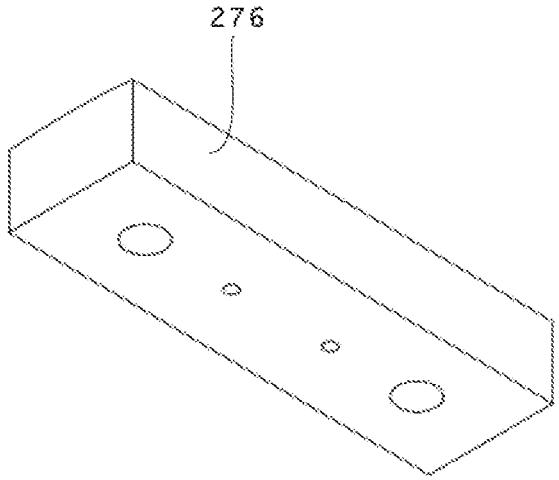
Figure 20C:
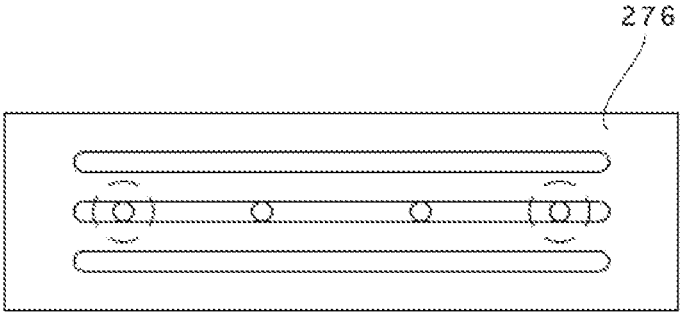
FIGS. 20*c*, 20*d* and 20*e* are top, side hidden detail and end hidden detail illustrating the insert of the rotor.
Figure 20D:
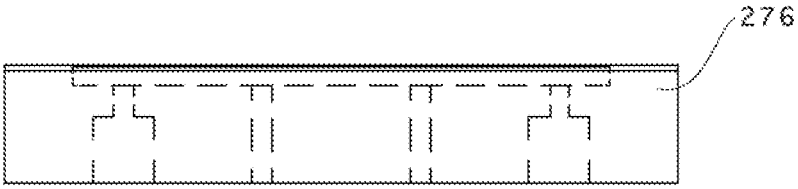
Figure 20E:
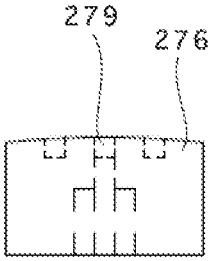

The A & B ports may be drilled in a top face 246 of the rear housing 220 and allow the insertion of fittings (not shown) to provide hydraulic fluid. The threaded ports A & B connect internally to drilled galleries 248 which communicate with the fluid transfer holes 249*a* and 249*b* that in turn communicate apertures 241*a* and 241*b* of the rear thrust plate 232, shown in FIG. 17*a*. The rear housing 220 also contains a blind hole 252 that houses a bush 254, shown in FIG. 15, that in turn supports the rear end of the shaft 218.

Rear Thrust Plate

Referring now to FIGS. 17*a* to 17*d*, the rear thrust plate 232 includes inner and outer annular concentric grooves 256*a*, 256*b* on a front face 251 thereof and apertures 241*a* and 241*b* on a rear face 243 that communicate with respective ones of the fluid transfer holes 249 with one of the inner and outer annular concentric grooves 256 providing an inlet flow and the other providing an outlet flow. The inner and outer annular concentric grooves 256*a*, 256*b* ultimately align with a respective port arrangement of the rotor 216 that includes inner and outer kidney ports 258*a* and 258*b* as best shown in FIGS. 19*a* to 19*f*

Intermediate Rotor Housing & Rotor

Referring additionally to FIGS. 18*a* to 18*c*, and FIGS. 19*a* to 19*f*, the intermediate rotor housing 224 includes an annular bore 260 in which the rotor 216 and followers 262 are located. The rotor housing 224 has machined radially extending follower recesses 225 in the form of slots 265 which allow linear extension and retraction of the followers 262. In operation, the intermediate rotor housing 224 does not rotate thereby acting as a stator. i.e. it remains in a fixed position relative to the device in which the motor 210 is attached. The rotor housing 224 provides a fixed object for the rotor 216 to react off to produce rotation.

The rotor 216 includes opposing front and rear sides 261, 263 and an outer circumferential surface 267 with two lobes 264 extending in a radial direction relative thereto. In this example, the lobes 264 are provided in the form of two equally circumferentially spaced apart lobes 264 at nominally 0 and 180 degrees. However, other numbers of and arrangements of lobes may be provided.

Figure 24A:
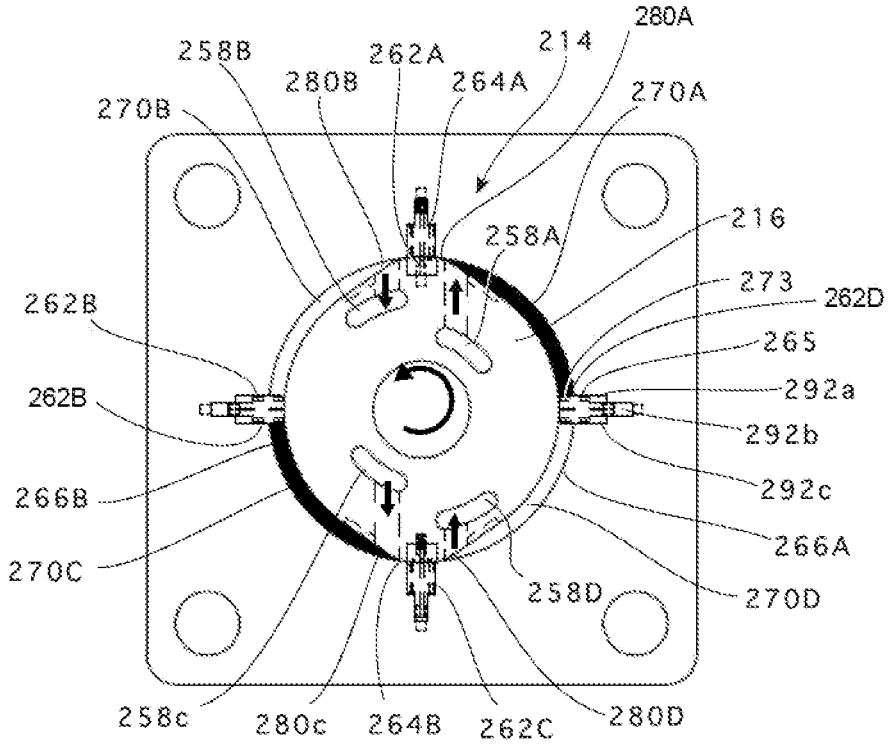
FIGS. 24*a*, 24*b*, 24*c* are functional rotational views illustrating the rotor within the rotor housing moving through the angles of 0, 45 and 90 degrees in an anti-clockwise direction.
Figure 24B:
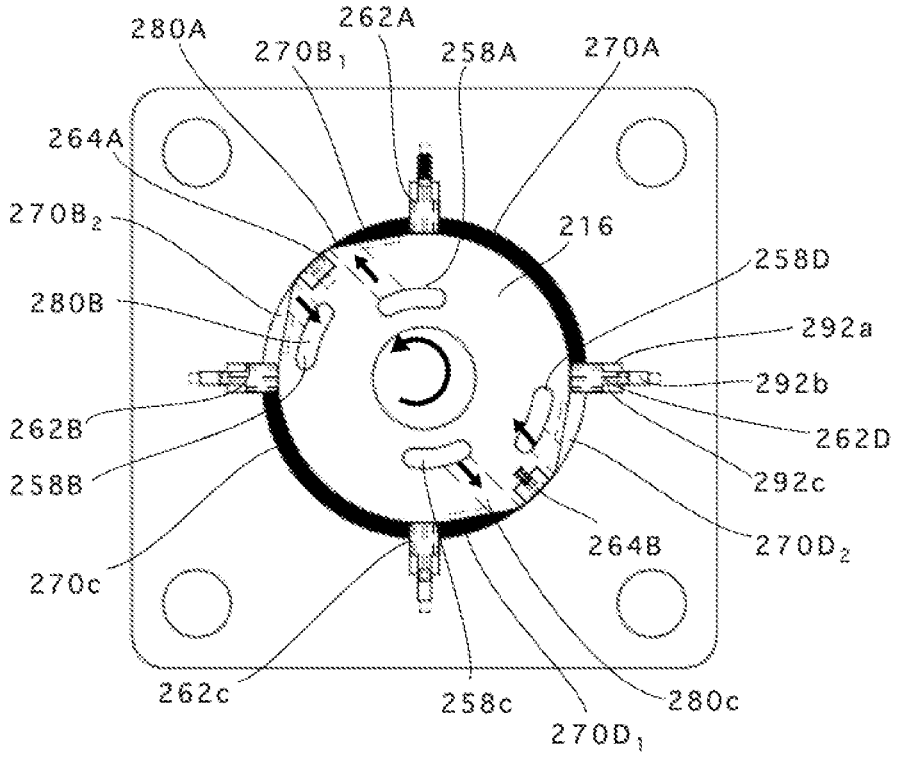
Figure 24C:
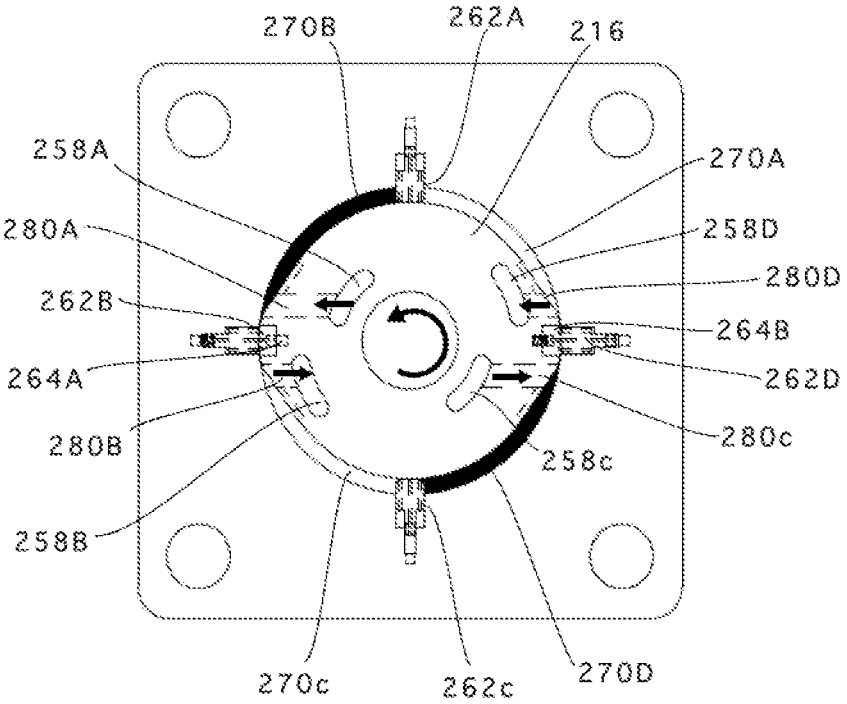

The diameter "DR" of the rotor 216 at the lobes 264 is about equal to the diameter "$D_H$" of the annular bore 260 of the rotor housing 224. Between the lobes 264 are defined troughs 266. The remaining diameter "Dr" of the rotor 216 is less than the diameter "$D_H$" of the annular bore 260 of the rotor housing 224 such that the followers 262 divide the troughs 266 to provide pressure chambers 270 (i.e. Chambers 270A, 270B, 270C and 270D as shown in FIGS. 24*a* to 24*c*) between the lobes 264, followers 262, rotor 216 and the rotor housing 224.

The rotor housing 224 has machined front and rear faces 268 which are presented flush with the opposing sides 261, 263 of the rotor 216 and follower end faces 287 so that the rotor housing 224 is coupled using the plurality of thru mounting holes 228 to the front and rear housing 220, 222 to facilitate the front and rear sealing of the motor pressure chambers 270. The rotor housing 224 may be made from ductile steel with sufficient yield strength to contain the high pressure, and also provides a circumferential internal surface 272 for the rotor lobes 264 to slide across. The displacement or the motor is largely determined by the annulus volume between the diameter $D_H$ of the housing bore 260 the diameter "Dr" of the rotor and the number of lobes 264 on the rotor 216.

Rotor

Turning now to the rotor 216 in more detail, the lobes 264 of the rotor 216 act as cams to actuate the followers 262, moving the followers 262 inwardly and outwardly as the rotor 216 rotates. The lobes 264 generate rotational torque through having unequal pressures on opposing sides thereof. It is noted that the example provided herein includes two lobes 264. However, further lobes can be added if the lobes 264 are evenly spaced around the circumference of the rotor. i.e. it is possible to have 2, 3, 4, 5, 6 and so on. Having two or more lobes 264 evenly spaced circumferentially ensures the rotor 216 is balanced radially. i.e. the pressure in the chambers 270 on opposing sides of the rotor 216 are relatively balanced. Multiple lobes also increase the motor displacement for a given rotor size.

Tips 274 of the rotor lobes 264 include recesses 275 having inserts 276, shown in FIGS. 20*a* to 20*e*, that form a seal between the rotor 216 and the rotor housing 224. The inserts 276 may be made of a softer material than the rotor housing 226 and are designed to wear over time. The inserts 276 are outwardly biased using springs 278 to ensure a seal is maintained between the rotor 216 and rotor housing 224 in the event of wear. A lubrication groove 279 ensures the insert remains hydrostatically balanced thereby preventing the rotor inserts 276 placing excessive pressure on the rotor housing 224 that would result in excessive wear.

It is noted that, preferably, the insert 276 is wider, in a circumferential direction, than a head portion 286 of the follower 262. This ensures that the insert 276 always remains in contact with the internal surface 272 of rotor housing 224 which ensures a seal is maintained across the recesses 275 as the insert 276 passes over the follower 262. The width of the insert 276 also ensures that the insert 276 does not move proud of the lobes 264 as it passes over the follower slot 265 of the rotor housing 224.

The front and rear faces 261, 263 of the rotor 216 include inlet and outlet side ports provided in this example as kidney ports 258. There are two kidney ports 258 for each lobe 264. The kidney 258 ports allow fluid to flow to the respective plurality of rotor inlet and outlet ports 280 on either side of the rotor lobes 264. The ports 280 on either side of the lobes 264 provide an inlet and outlet, respectively, as indicated by 280A and 280B on FIG. 19*f* The ports 280 may be on the sloped face of the lobes 264 and may include shallow grooves 277 extending from the ports 280 in a direction away from the lobes 264.

The kidney shape of the ports 258 allows alignment with the annular grooves 256 of the rear thrust plate 232. This facilitates uninterrupted flow between the stationery rear thrust plate 232 and the rotor 216 during rotation. The kidney ports 258*b* on the inner Pitch Circle Diameter connect to the common annular groove 256*b* and are open to the motor B port. The kidney ports 258*a* on the outer Pitch Circle Diameter connect to the common annular groove 256*a* that is open to the motor A port. The rotor ports 280 include pressure-relieving grooves 282, which also facilitate the removal of oil from behind the followers 262 as they retract. The rotor 216 includes a spline (not shown) that mates with the shaft 218.

The rotor 216 may be considered a "ported rotor" that advantageously allows a consistent pressure to be applied to the lobes 264 because irrespective of the rotation angle, pressure is being generated via flow from the ported lobe. The ports 258 through the rotor 216 provide hydrostatic balancing of the rotor 216 between the forward and rear thrust plates 232, 306.

Followers

Turning now to the follows 262 and referring additionally to FIGS. 21*a* to 21*d*, the followers 262 function as seals between the chambers 270 at working pressure (e.g. Chamber 270A as shown in FIG. 24*a*) and at return pressure (e.g. Chamber 270B as shown in FIG. 24*b*). The followers 262 also provide side surfaces 273*a* and 273*b* that the rotor 216 is able to react off to generate rotation as the followers 262 are seated with the slots 265 within the rotor housing 224 that inhibits any rotation or lateral movement of the followers 262.

It is preferable to have at least two followers 262 for each lobe 264 of the rotor 216. This ensures the pressure at inlet ports 280A of the preceding rotor lobe 264 are not connected via the chamber 270 through to the tank or outlet ports 280D of the following rotor lobe 262. In other words, the followers 262 divide the troughs 266 between the lobes 264 to create the chambers 270 providing a seal between adjacent ports 280. The followers 262 have radii on the leading and trailing edges 284, 285 to ensure smooth retraction and extension of the followers 262. Additionally, a head surface 286 of the followers 262 that slides on the circumferential internal surface of rotor 216 a radius to match the diameter Dr of the rotor 216 to improve sealing.

The follower 262 is urged toward the circumferential outer surface 267 of the rotor 216 via a bias in the form of springs 288 between the followers 262 and the slot 265 of the rotor housing 224. Accordingly, in use, the followers 262 generally "follow" the circumferential outer surface 267 as the rotor 216 is rotated, and extend and retract to follow the lobes 264 and troughs 266 therebetween. To reduce scoring of the circumferential outer surface 267, the followers 262 may be made of a softer material.

Figure 21A:
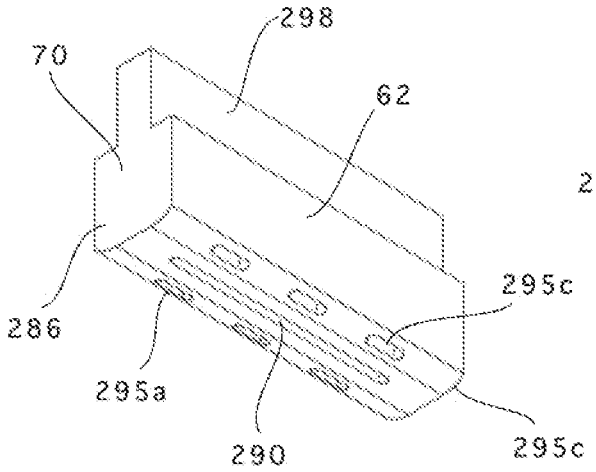
FIGS. 21*a* and 21*b* are bottom side isometric and top side isometric views illustrating a follower of the rotor housing.
Figure 21B:
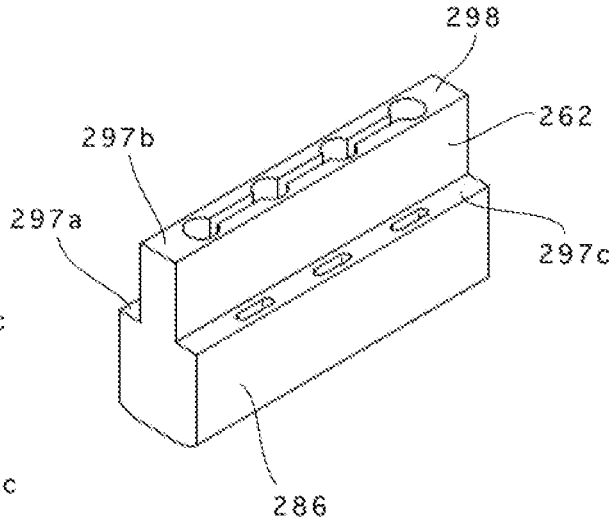
Figure 21C:
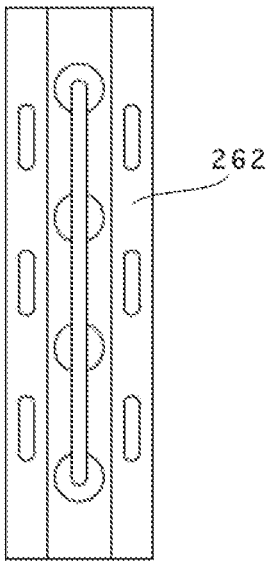
FIGS. 21*c* and 21*d* are top and end hidden detail views illustrating the follower of the rotor housing.
Figure 21D:
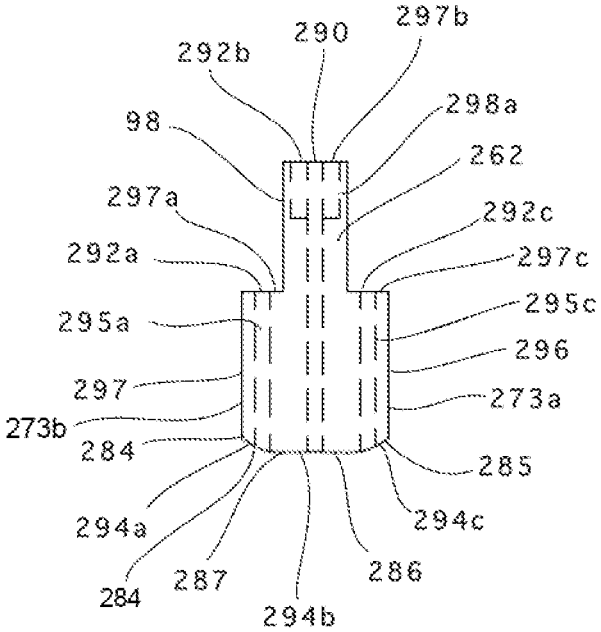

In more detail, as best shown in FIG. 21*d*, the followers 262 are each T-shaped when viewed in side cross sectional profile having a head portion 286 and a base portion 298. This T-shape profile provides three upper surfaces 294*a*, 294*b* and 294*c* and three corresponding underside surfaces 297*a*, 297*b*, and 297*c* that define three pressure zones being an intermediate pressure zone 292*b* and two lateral pressure zones 292*a* and 292*c* between the three underside surfaces 297*a*, 297*b*, and 297*c* and the follower recesses 225.

To minimize friction, the hydraulic fluid may act as a lubricant between the circumferential outer surface 267 and the followers 262. The lubricating film in this area will be at pressure, which would ordinarily create an imbalance of forces on the cam follower 262 causing it to retract, and thereby separate from the circumferential outer surface 267 causing leakage and loss of efficiency. Accordingly, to counteract this pressure imbalance, a passage 290 in the form of a thru hole or slot in the head portion 286 of the followers 262 allows oil to pass through to the intermediate pressure zone or chamber 292*b* (shown in FIG. 24*a*) which balances the pressure to allow the followers 262 to remain hydrostatically balanced.

In addition to the thru hole or slot 290 in centre of the head portion 286, in this example, the followers 262 also include further plurality of thru-holes 295*a*, 295*c* drilled between the lateral upper surfaces 294*a*, 294*c* to the corresponding underside surfaces 297*a* and 297*c*. The thru-holes 295*a*, 292*b*, 295*c* allow fluid pressure to balance between the three upper surfaces 294*a*, 294*b* and 294*c* and intermediate pressure zone 292*b* and two lateral pressure zones 292*a* and 292*c* between the followers 262 and the follower recesses 225.

This ensures that the net force applied to the rotor 216 by the follower 262 is predominately controlled by the springs 288. It is noted that interchanging the springs 288 with various spring rates can be used to alter the speed rating of the motor. (i.e stiffer bias springs will hold the cam follower onto the rotor lobes at higher speeds). Similarly, to the previous first example, the centre slot 290 could be sealed and instead have a pilot pressure acting on surface 297*b* to assist the bias springs in pushing the follower 262 onto the rotor surface.

It is noted that the three pressures at the underside surfaces 297*a*, 297*b* and 297*c* allow the varying profile on the face (i.e. the leading edge radii and the head radius to match the rotor) that mates with the rotor 16 to remain hydrostatically balanced.

In this example, the base portion 298 is a tab or stem 298*a* that extends from the head portion 286 to separate or divide the intermediate pressure zone 292 band from the lateral pressure zones 292*a* and 292*c*. The tab 298*a* is received by a narrowed sectioned 300 of the slot 265 that extending from a wide section 301, shown in FIG. 18*c*, in which the head portion 286 is received. The wide section 301 and narrowed sectioned 300 define shoulders 102 there between to provide an end of travel stop for the underside surfaces 297*a* and 297*c*.

As stated previously, the thru slot 290 in the face 287 of the follower 262 allows hydraulic fluid to pass through to the underside surface 297*b* of the tab 298*a*. This balances the lubricating film pressure. During the follower 262 retraction toward and into the slot 265, hydraulic fluid will be displaced from behind the follower 262 back through to the low-pressure side of the rotor lobe 264.

Front Housing

Figure 22A:
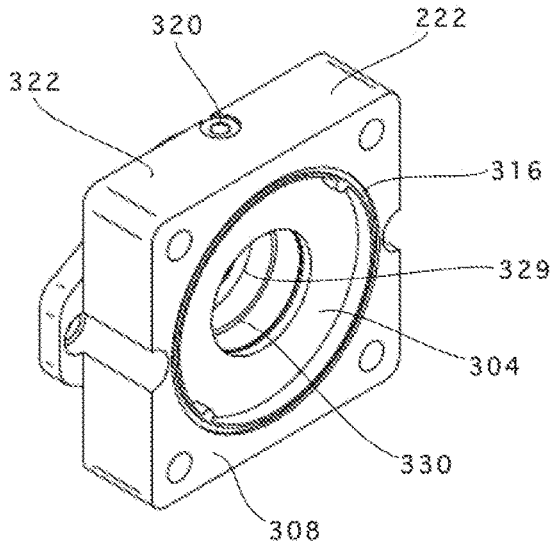
FIGS. 22*a*, 22*b* and 22*c* are isometric rear, front and rear views illustrating a front housing of the motor.
Figure 22B:
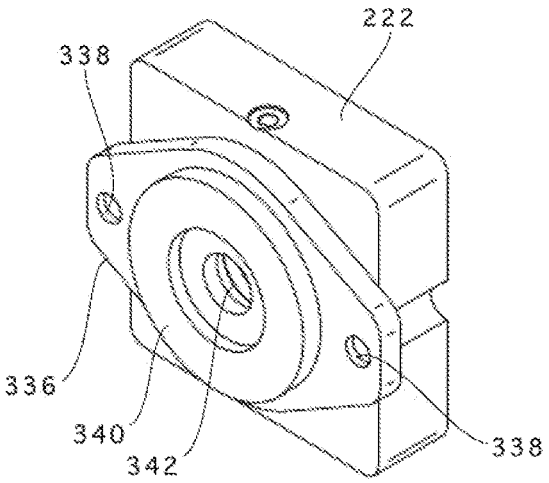
Figure 22C:
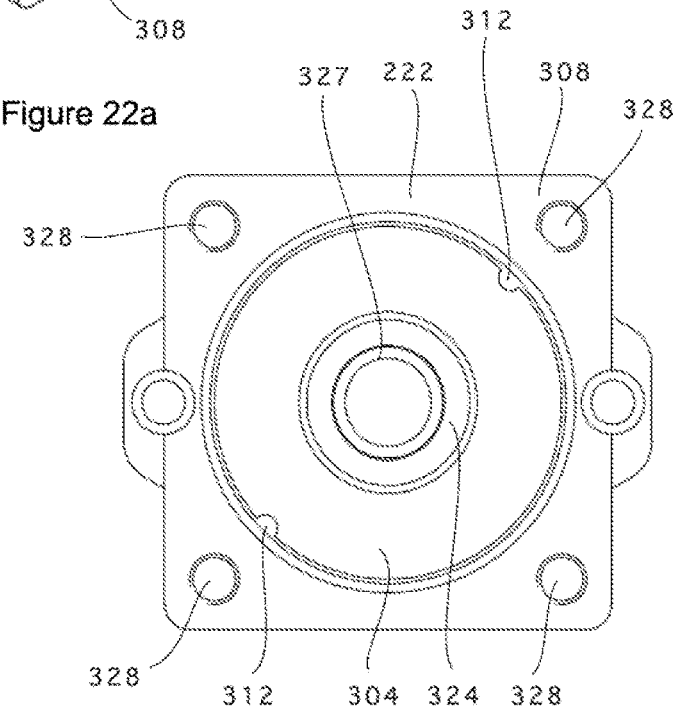

Referring now to FIGS. 22*a* to 22*c*, the front housing 222 may be manufactured from ductile steel. The front housing 222 includes a cut-out 304 in which a front thrust plate 306 (shown in FIG. 15) is received. The depth of the cut-out 304 is such that when received a rear face 308 of the front housing 222 and a rear face 310 of the front thrust plate 306 are flush. The front housing 222 including locators in the form of male notches 312 that match with corresponding locators in the form of female notches 314 of the front thrust plate 306 ensuring correct assembly. The front housing 222 contains an annular groove 316 for an elastomer seal 318. The elastomer seal 318 sits between the rear face 308 of the front housing 222 and the rotor housing 224 to inhibit leakage to the external environment.

A threaded drain port 320 is drilled into a top face 322 of the front housing 222 and allow the insertion of fittings (not shown) which can be adapted to fluid transfer conduits connected to a reservoir at low pressure. The drain port 320 is provided to allow removal of fluid that may have leaked from the pressure chambers 270. A circular bearing recess 324 concentric with a rear bushing 254 and a rotor drive spline 346 provides a location for a shaft roller bearing 326 which provides radial support for the shaft 218 and allows rotation of the shaft 218 with a high degree of mechanical efficiency. A groove 330 in the front housing 222 behind the bearing recess 324 enables the insertion of a snap ring 332 to prevent axial movement of the bearing 326. The circular recess 329 enables the insertion of a shaft seal 334. The shaft seal 334 eliminates leakage to the external environment by creating a seal between the housing 222 and the shaft 218.

The front housing 222 contains the plurality of threaded apertures 328 which enable it to be clamped to the rotor housing 224 and rear housing 220 via the fasteners 226 The front housing 222 has a front flange 336 that may be a standard SAE mounting configuration. i.e. the mounting holes 338, the mounting hole PCD and the mounting spigot 340 may be standard to allow easy coupling to the device to be driven by the motor. There is a hole 342 though the length of the front housing 222 to accommodate the shaft 218 and to allow it to protrude out from the front flange 336.

Front Thrust Plate

Figure 23A:
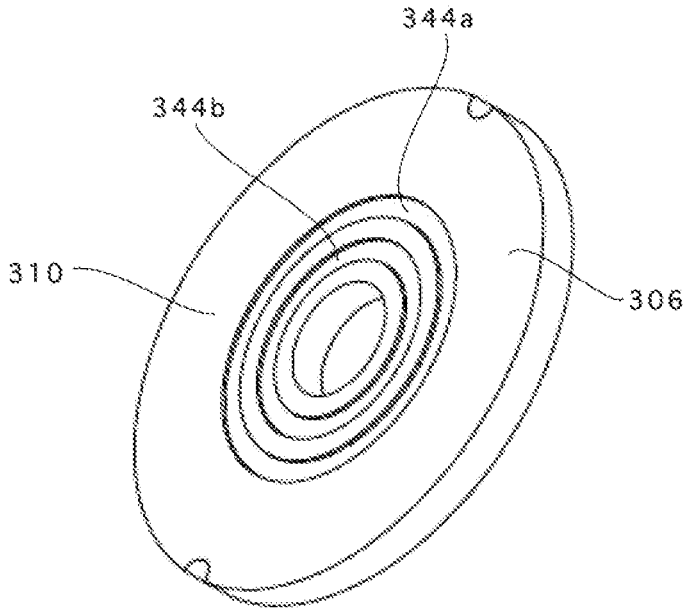
FIGS. 23*a*, 23*b* and 23*c* are isometric rear, side sectional and rear views illustrating a front thrust plate of the motor.
Figure 23B:
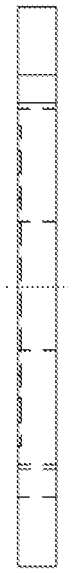
Figure 23C:
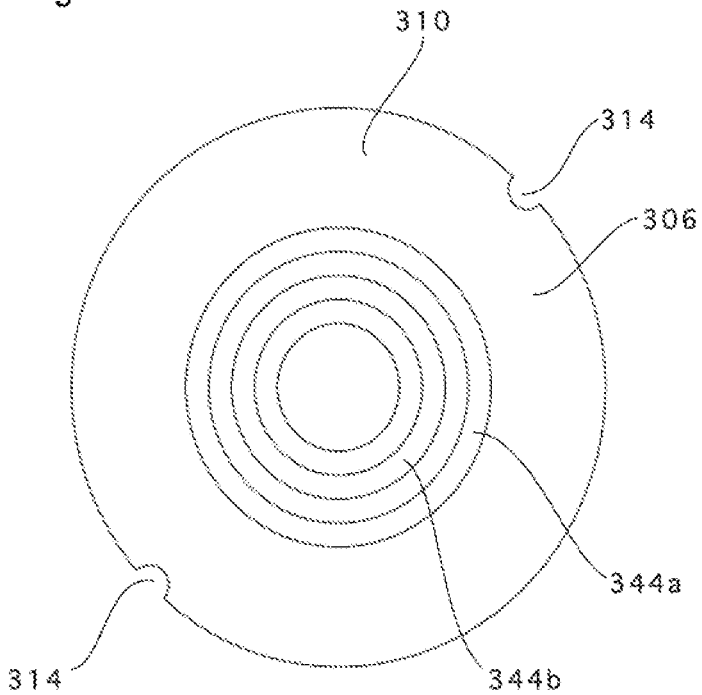

Referring to FIGS. 23*a* to 23*c*, the front thrust plate 306 provides a flat surface for the rotor 216 to abut thereby providing thrust support and to minimize leakage from the rotor pressure chambers 270. The overall shape of front thrust plate 306 may be an approximate mirror image of the rear thrust plate 232 that assists the rotor 216 to be hydrostatically balanced axially (i.e. the fluid pressure on the equal areas of the opposing thrust plates will be approximately equal generating an approximately zero net force on the rotor). This results in reduced friction and wear and greater mechanical efficiency.

The rear face 310 of the front thrust plate 306 has two inner and outer annular grooves 344*a*, 344*b*. These annular grooves 344 mirror the annular grooves 256 of the rear thrust plate 232 but are at a shallower depth and blinded as they do not transfer flow. The front thrust plate 306 may be made of a softer material than the rotor 216, to facilitate minimal clearance between the rotor 216 and front thrust plate 306, and thereby limit leakage. The front thrust plate 306 has the plurality of notches 314 that prevent rotation of the thrust plate 306 during operation.

Shaft

The shaft 218 is elongated and may be manufactured from a hi-tensile steel. The shaft 218 is the means by which the rotation generated by the rotor 216 is transmitted to the device (not shown) being driven. The shaft 218 has a spline 346 machined to mate with a corresponding spline 348 on the inside diameter of the rotor 216. The shaft 218 couples to the device (not shown) to be driven by either the key 328 or spline compatible with the said device. The shaft 218 has various diameters that are at sizes to suit the bushing 254, bearing 326 and shaft seal 334 and to also allow assembly and free rotation during operation.

Use and Operation

Referring now to FIGS. 24*a* to 24*c*, a sequence of the rotation of the motor 210 is shown through 90 degrees to explain the movement of the hydraulic fluid, rotor 216 and followers 262. It is noted that an anti-clockwise sequence is shown for example purposes and the direction of rotation can be reversed by reversing the direction of flow from the inlet A and outlet B ports. The motor 210 may be connected via inlet and outlet ports A and B to pressurise hydraulic fluid supply and a return tank that is at relatively lower pressure. It is noted the use of capital identifiers "A", "B" (i.e. 258A) is used to distinguished between lower case identifiers "a" (i.e 258*a*) used elsewhere in the specification.

Beginning at FIG. 24*a*, pressurised hydraulic fluid is supplied to the kidney ports 258A and 258C that is delivered to chambers 270A and 270C via ports 280A and 280C, respectively. At the same time, chambers 270B and 270D are communicated to the return tank via ports 280B and 280D and associated kidney ports 258B and 258D such that hydraulic fluid within the chambers 270B and 270D is exhausted to the tank. The pressurised hydraulic fluid in chambers 270A and 270C reacts against extended followers 262B and 262D and the adjacent surfaces of the lobes 264A and 264B to initiate rotation movement of the rotor 216 relative to the rotor housing 224.

The kidney ports 258A and 258C are communicated with the inner and outer annular concentric grooves 256 of the rear thrust plate 232 and ultimately the inlet and outlet ports A and B.

Referring to FIG. 24*b*, the rotor 216 is shown being rotated 45° counter clockwise relative to FIG. 24*a*. At this angle, the chambers are further divided by the followers 262 into chambers 270$B_1$ and 270$D_1$ that are pressurised, and chambers 270$B_2$ and 270$D_2$ that are exhausting. Chambers 270C and 270A are isolated by the followers 262 that have extended so as to provide a neutral pressure on rotation. The chambers 270$B_1$ and 270$D_1$ continue to drive the rotation.

Next, referring to FIG. 24*c*, chambers 270B and 270D are pressurised with hydraulic fluid supplied from the kidney ports 258A and 258C that is delivered to chambers 270B and 270D via ports 280A and 280C. At the same time, chambers 270A and 270C are communicated to the return tank via ports 280B and 280D and associated kidney ports 258B and 258D such that hydraulic fluid within the chambers 270A and 270C is exhausted to the tank.

Followers 262B and 262D are retracted to accommodate the lobes 264A and 264B and the follows 262A and 262C are extended into the trough 266 between the lobes 264 to meet the rotor 216 and define the adjacent chambers 270.

The motor 210 may continue to rotate in the above sequence whilst pressurised hydraulic fluid is supplied and exhausted from ports A and B, respectively. The direction of rotation may be reversed by swapping the pressurised fluid to port B and the exhaust to port A. It is noted that the symmetrical arrangement of the motor 210 allows rotation in either direction.

The above described examples of the rotary fluid device provide a number of advantages that achieve a relatively compact, efficient and simple design that may allow manufacturing cost savings. The rotary fluid device may function as a motor or as a pump.

In particular, a limitation of existing vane motors and vane pumps, is the maximum displacement for a given envelope size and maximum operating pressure. Vane pumps and motors generally port oil at operating pressure to the top side of the vane to hold it against the stator running surface. Because there is only a single pressure zone on the top surface, the wider the vane the higher the force pushing the vane. This higher force results in higher friction and consequently lower mechanical efficiency. To mitigate against lower mechanical efficiency, the vanes are often manufactured thinly to reduce the force generated. However, this limits the stroke and operating pressure of the vanes. A high operating pressure results in higher bending stresses in the vanes as does a larger stroke. Having a smaller stroke means a smaller displacement.

Now, the disclosed followers seek to overcomes the limitations of the vane by having three pressure zones which hydrostatically balance the follower with only the bias spring force and centrifugal forces keeping the follower against the stator running surface. The pilot pressure may also optionally be used.

This means the follower can be made much wider allowing longer strokes and higher operating pressures for a given motor/pump envelope. i.e. the bending stress on the followers is much less than on a vane of the equivalent stroke. Mechanical efficiency can therefore also be maintained.

Another advantage of the wider followers, is that steeper lobe angles can be used. A steeper angle applies a higher bending load to the vane or follower. A steeper lobe angle should generally enable the addition of more lobes per revolution increasing the displacement of the motor/pump. A steeper lobe angle also allows a larger differential between the rotor radius and housing radius creating larger troughs and consequently high displacements for a given overall size.

In addition to the above, the insert has a couple of advantages over a conventional vane motor or pump. In a vane motor or pump, the distance of the stator between a pressure chamber and a tank pressure chamber must be longer than the distance between two vanes. This is so the vanes maintain a seal between the chambers at different pressures. This requires additional vanes over and above my design. Additional vanes mean lower mechanical efficiency as there is higher friction. The insert also takes up less stator circumferential space, allowing more room to achieve higher displacements for the same lobe slope angle.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any known matter or any prior publication is not, and should not be taken to be, an acknowledgment or admission or suggestion that the known matter or prior art publication forms part of the common general knowledge in the field to which this specification relates.

While specific examples of the invention have been described, it will be understood that the invention extends to alternative combinations of the features disclosed or evident from the disclosure provided herein.

Many and various modifications will be apparent to those skilled in the art without departing from the scope of the invention disclosed or evident from the disclosure provided herein.

The invention claimed is:

1. A rotary fluid device, the rotary fluid device including an outer housing assembly and an inner rotating arrangement adapted to rotate relative to the outer housing assembly, the outer housing assembly including a rotor housing and the inner rotating arrangement including a rotor dimensioned to rotatably fit within the rotor housing, wherein the rotor includes opposing sides and an outer circumferential surface and the rotor housing includes an inner circumferential surface extending about the outer circumferential surface of the rotor, wherein one of the rotor and the rotor housing include lobes extending in a radial direction relative to the respective inner and outer circumferential surfaces and the other of the rotor and the rotor housing includes followers and follower recesses in which the followers are moveably located, wherein the lobes are arranged to define troughs therebetween extending between the inner and outer circumferential surfaces and the followers are moveable between an extended condition and a retracted condition relative to the follower recesses so as to substantially sealably follow the respective one of the inner and outer circumferential surfaces with the troughs being dividable by the followers during rotation of the rotor into chambers, and at least one of the rotor and the rotor housing includes a port arrangement such that circumferentially adjacent ones of the chambers are provided with a differential in fluid pressure so as to urge the rotor in a circumferential direction, and wherein the followers and follower recesses are adapted such that in at least the extended condition three pressure zones are defined between the followers and follower recesses, the three pressure zones including an intermediate pressure zone and two laterally adjacent pressure zones on opposing circumferentially lateral sides of the intermediate pressure zone, wherein each one of the followers includes three top facing surfaces facing away from a respective one of the follower recesses and three opposing underside facing surfaces that are arranged to define the intermediate pressure zone and the two laterally adjacent pressure zones between the three opposing underside facing surfaces and the respective one of the follower recesses, and wherein the followers and follower recesses are adapted such that in at least the extended condition fluid pressure at each of the three opposing underside facing surfaces are substantially hydrostatically balanced with a fluid pressure at each of the respective three top facing surfaces exposed to the chambers.

2. The rotary fluid device according to claim 1, wherein the followers each include a head portion adapted to slidably engage with the respective one of the inner and outer circumferential surfaces and a base portion received by the respective follower recesses.

3. The rotary fluid device according to claim 2, wherein the three top facing surfaces include a tip surface of the head portion and top surfaces provided by radiused leading and trailing edges of the head portion on each lateral side of the tip surface.

4. The rotary fluid device according to claim 3, wherein the head portion includes at least one aperture extending from the tip surface to the intermediate pressure zone.

5. The rotary fluid device according to claim 4, wherein the intermediate pressure zone is within the respective follower recesses.

6. The rotary fluid device according to claim 5, wherein the three underside facing surfaces of the followers include an underside surface of the head portion, and wherein the at least one aperture extends from the tip surface to the underside surface of the head portion.

7. The rotary fluid device according to claim 5, wherein the three opposing underside facing surfaces of the followers include underside surfaces of the base portion.

8. The rotary fluid device according to claim 7, wherein the two laterally adjacent pressure zones are located at least partially between the three opposing underside facing surfaces of the base portion and the respective follower recesses in at least the extended condition.

9. The rotary fluid device according to claim 8, wherein the two laterally adjacent pressure zones and the intermediate pressure zone are separated from one another by a divider provided by at least one of the followers and follower recesses.

10. The rotary fluid device according to claim 8, wherein the base portion includes locating portions located on opposing sides of the base portion, the locating portions being adapted to be slidably received by the follower recesses.

11. The rotary fluid device according to claim 10, wherein the two laterally adjacent pressure zones are provided between an underside of the locating portions and the follower recesses in at least the extended condition.

12. The rotary fluid device according to claim 10, wherein the followers and follower recesses are shaped to provide passages to communicate fluid between the respective chambers and the two laterally adjacent pressure zones.

13. The rotary fluid device according to claim 6, wherein the base portion includes locating portions located on opposing sides of the base portion, the locating portions being adapted to be slidably received by the follower recesses and wherein the two laterally adjacent pressure zones are provided between corresponding underside surfaces of the locating portions and the follower recesses in at least the extended condition.

14. The rotary fluid device according to claim 2, wherein the head portion is radiused to match with one of the respective inner and outer circumferential surfaces.

15. The rotary fluid device according to claim 2, wherein the head portion includes radii on respective leading and trailing edges of the head portion.

16. The rotary fluid device according to claim 1, wherein the followers are biased away from the respective follower recesses.

17. The rotary fluid device according to claim 16, wherein the bias is provided by at least one of a spring and a pilot pressure provided to the intermediate pressure zone.

18. The rotary fluid device according to claim 1, wherein tips of the lobes include moveable inserts intermediate of the tips.

19. The rotary fluid device according to claim 18, wherein the moveable inserts are wider in a circumferential direction than the head portion of the followers.

20. The rotary fluid device according to claim 19, wherein each of the moveable inserts includes an aperture between its underside surface and an opposing tip surface exposed to the chamber so as to allow hydrostatic balancing thereof.

21. The rotary fluid device according to claim 1, wherein the three pressure zones are substantially independent.

22. The rotary fluid device according claim 1, wherein the followers each include a head portion having the three top facing surfaces, the three top surfaces being provided respectively by a radiused leading edge of the head portion, a radiused trailing edge of the head portion and a tip of the head portion intermediate the leading edge and the trailing edge.

23. A rotary fluid device, the rotary fluid device including an outer housing assembly and an inner rotating arrangement adapted to rotate relative to the outer housing assembly, the outer housing assembly including a rotor housing and the inner rotating arrangement including a rotor dimensioned to rotatably fit within the rotor housing, wherein the rotor includes opposing sides and an outer circumferential surface and the rotor housing includes an inner circumferential surface extending about the outer circumferential surface of the rotor, wherein one of the rotor and the rotor housing include lobes extending in a radial direction relative to the respective inner and outer circumferential surfaces and the other of the rotor and the rotor housing includes followers and follower recesses in which the followers are moveably located, wherein the lobes are arranged to define troughs therebetween extending between the inner and outer circumferential surfaces and the followers are moveable between an extended condition and a retracted condition relative to the follower recesses so as to substantially sealably follow the respective one of the inner and outer circumferential surfaces with the troughs being dividable by the followers during rotation of the rotor into chambers, and at least one of the rotor and the rotor housing includes a port arrangement such that circumferentially adjacent ones of the chambers are provided with a differential in fluid pressure so as to urge the rotor in a circumferential direction, and wherein the followers and follower recesses are adapted such that in at least the extended condition three pressure zones are defined between the followers and follower recesses, the three pressure zones including an intermediate pressure zone and two laterally adjacent pressure zones on opposing circumferentially lateral sides of the intermediate pressure zone, wherein tips of the lobes include moveable inserts intermediate of the tips.

* * * * *